US009583035B2

(12) United States Patent
Buckley et al.

(10) Patent No.: US 9,583,035 B2
(45) Date of Patent: Feb. 28, 2017

(54) DISPLAY INCORPORATING LOSSY DYNAMIC SATURATION COMPENSATING GAMUT MAPPING

(71) Applicant: Pixtronix, Inc., San Diego, CA (US)

(72) Inventors: Edward Buckley, Melrose, MA (US); Nathaniel Smith, Lawrence, MA (US)

(73) Assignee: SnapTrack, Inc., San Diego, CA (US)

( * ) Notice: Subject to any disclaimer, the term of this patent is extended or adjusted under 35 U.S.C. 154(b) by 65 days.

(21) Appl. No.: 14/520,994

(22) Filed: Oct. 22, 2014

(65) Prior Publication Data

US 2016/0117967 A1 Apr. 28, 2016

(51) Int. Cl.
*G09G 3/20* (2006.01)
*G09G 3/34* (2006.01)

(52) U.S. Cl.
CPC ..... *G09G 3/2003* (2013.01); *G09G 3/3433* (2013.01); *G09G 2300/02* (2013.01); *G09G 2300/0469* (2013.01); *G09G 2320/0666* (2013.01); *G09G 2340/06* (2013.01)

(58) Field of Classification Search
CPC ..... G09G 2320/0666; G09G 2340/02; G09G 2340/06; G09G 5/00
See application file for complete search history.

(56) References Cited

U.S. PATENT DOCUMENTS 7,339,700 B2 3/2008 Ohga et al.
8,233,013 B2 7/2012 Morisue et al.
8,648,968 B2 2/2014 Hou et al.
2010/0164980 A1* 7/2010 Ten ..... G09G 5/00 345/603
2010/0225673 A1 9/2010 Miller et al.
2011/0043535 A1 2/2011 Kwiatkowski et al.
2011/0216097 A1 9/2011 Yoo et al.
2011/0234644 A1 9/2011 Park et al.
2012/0320113 A1 12/2012 Hagood, IV et al.
2014/0044352 A1 2/2014 Sarkar et al.

OTHER PUBLICATIONS

Bergquist J., et al. "49.2: Field-Sequential-Colour Display with Adaptive Gamut," SID Symposium Digest of Technical Papers, Jun. 2006, vol. 37 (1), pp. 1594-1597.

* cited by examiner

*Primary Examiner* — Gerald Johnson

(74) *Attorney, Agent, or Firm* — Foley & Lardner LLP; Paul S. Hunter

(57) ABSTRACT

This disclosure provides systems, methods, and apparatus for generating images on a multi-primary display. A multi-primary display can include control logic that converts input image data into the multi-primary color space employed by the display by mapping the input pixel values into an intermediate color space according to a gamut mapping function and then decomposing the mapped pixel values into color subfields associated with the display's primary colors. The control logic can be configured to identify a lossy gamut mapping saturation parameter value to use in the gamut mapping process which results in a power-saving desaturated image that is perceived by the Human Visual System (HVS) as substantially maintaining its color fidelity.

25 Claims, 10 Drawing Sheets

DISPLAY INCORPORATING LOSSY DYNAMIC SATURATION COMPENSATING GAMUT MAPPING

TECHNICAL FIELD

This disclosure relates to the field of imaging displays, and in particular to image formation processes for multi-primary displays.

DESCRIPTION OF THE RELATED TECHNOLOGY

Electromechanical systems (EMS) include devices having electrical and mechanical elements, actuators, transducers, sensors, optical components such as mirrors and optical films, and electronics. EMS devices or elements can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

EMS-based display apparatus can include display elements that modulate light by selectively moving a light blocking component into and out of an optical path through an aperture defined through a light blocking layer. Doing so selectively passes light from a backlight or reflects light from the ambient or a front light to form an image.

SUMMARY

The systems, methods and devices of this disclosure each have several innovative aspects, no single one of which is solely responsible for the desirable attributes disclosed herein.

One innovative aspect of the subject matter described in this disclosure can be implemented in an apparatus that includes an array of display elements and control logic. The control logic is capable of receiving an image frame, which includes, for each of a plurality a pixels, a first set of color parameter values. The control logic is further capable of generating an output image frame. The control logic generates the output image frame by obtaining a gamut mapping saturation parameter. For each pixel in the received image frame, using the gamut mapping saturation parameter, the control logic applies a content adaptive gamut mapping process to the first set of color parameter values associated with the pixel to map the first set of color parameter values to a second set of color parameter values. Generating the output image frame further includes decomposing the second set of color parameter values associated with the plurality of pixels to form pixel intensity values in respective color subfields associated with at least four different colors and generating display element state information for the display elements based on the color subfields. The control logic is further capable of outputting the output image frame to the array of display elements, determining a color difference between the output image frame and a reference output image frame, and updating the gamut mapping saturation parameter based on the determined color difference.

In some implementations, updating the gamut mapping saturation parameter includes comparing the determined color difference to a threshold color difference and, in response to the color difference falling below the threshold color difference, adjusting the gamut mapping saturation parameter to increase the color difference in a subsequently generated output image frame. In some implementations, updating the gamut mapping saturation parameter includes comparing the determined color difference to a threshold color difference and, in response to the color difference exceeding threshold color difference, adjusting the gamut mapping saturation parameter to decrease the color difference in a subsequently generated output image frame. In some implementations, updating the gamut mapping saturation parameter includes applying a proportional-integral-derivative (PID) controller-based updating process.

In some implementations, the color difference includes a retinex measure indicating an average color difference between the output image frame and the reference output image frame. In some implementations, the color difference is indicative of a difference in at least one of chromaticity and luminance.

In some implementations, the reference output image frame includes an output image resulting from the application of the gamut mapping process to a reference input image frame using a gamut mapping saturation parameter that yields more desaturation to a reference image frame. In some implementations, the first set of color parameter values include red, green, and blue pixel intensity values and the second sets of color parameter values include XYZ tristimulus values.

In some implementations, the reference input image frame includes an image in a same video scene as the received input image frame. In some implementations, the received input image frame is a still image, and the reference input image frame includes the identical image data to the received input image frame. In some implementations, the control logic can be further capable of generating the reference output image frame using a lossless gamut mapping saturation parameter.

In some implementations, obtaining the gamut mapping saturation parameter includes determining that the received image frame is associated with a scene change and identifying a lossless gamut mapping saturation parameter for the received image frame.

In some implementations, the apparatus further includes a display including the array of display elements, a processor capable of communicating with the display and capable of processing image data, and a memory device capable of communicating with the processor. In some implementations, the apparatus further includes a driver circuit capable of sending at least one signal to the display and a controller capable of sending at least a portion of the image data to the driver circuit. In some implementations, the apparatus includes an image source module capable of sending the image data to the processor, where the image source module includes at least one of a receiver, transceiver, and transmitter. In some implementations, the apparatus further includes an input device capable of receiving input data and to communicate the input data to the processor.

Another innovative aspect of the subject matter described in this disclosure can be implemented in a computer readable medium storing computer executable instructions, which when executed by a processor cause the processor to carry out a method of forming an image on a display. The method includes receiving an input image frame. The input image frame includes, for each of a plurality a pixels, a first set of color parameter values. The method also includes generating an output image frame. Generating the output image frame includes obtaining a gamut mapping saturation parameter. The method further includes, for each pixel in the received image frame, using the gamut mapping saturation parameter, applying a content adaptive gamut mapping process to the first set of color parameter values associated with the pixel to map the first set of color parameter values to a second set of color parameter values. Generating the output image frame further includes decomposing the second set of color parameter values associated with the plurality of pixels to form pixel intensity values in respective color subfields associated with at least four different colors and generating display element state information for the display elements based on the color subfields. The method also includes outputting the output image frame to the array of display elements, determining a color difference between the output image frame and a reference output image frame, and updating the gamut mapping saturation parameter based on the determined color difference.

In some implementations, updating the gamut mapping saturation parameter includes comparing the determined color difference to a threshold color difference. In response to the color difference falling below the threshold color difference, the gamut mapping saturation parameter is adjusted to increase the color difference in a subsequently generated output image frame. In response to the color difference exceeding the threshold color difference, the gamut mapping saturation parameter is adjusted to decrease the color difference in a subsequently generated output image frame. In some implementations, updating the gamut mapping saturation parameter includes applying a proportional-integral-derivative (PID) controller-based updating process.

In some implementations, the reference output image frame includes an output image resulting from the application of the gamut mapping process to a reference input image frame using a lossless gamut mapping saturation parameter. In some implementations, the reference input image frame includes one of an image in a same video scene as the received input image frame and an image frame including the identical image data to the received input image frame. In some implementations, the method further includes generating the reference output image frame using a lossless gamut mapping saturation parameter. In some implementations, obtaining the gamut mapping saturation parameter includes determining that the received image frame is associated with a scene change and identifying a lossless gamut mapping saturation parameter for the received image frame.

In some implementations, the color difference includes a retinex measure indicating an average color difference between the output image frame and the reference output image frame. In some implementations, the first set of color parameter values include red, green, and blue pixel intensity values and the second sets of color parameter values include XYZ tristimulus values.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
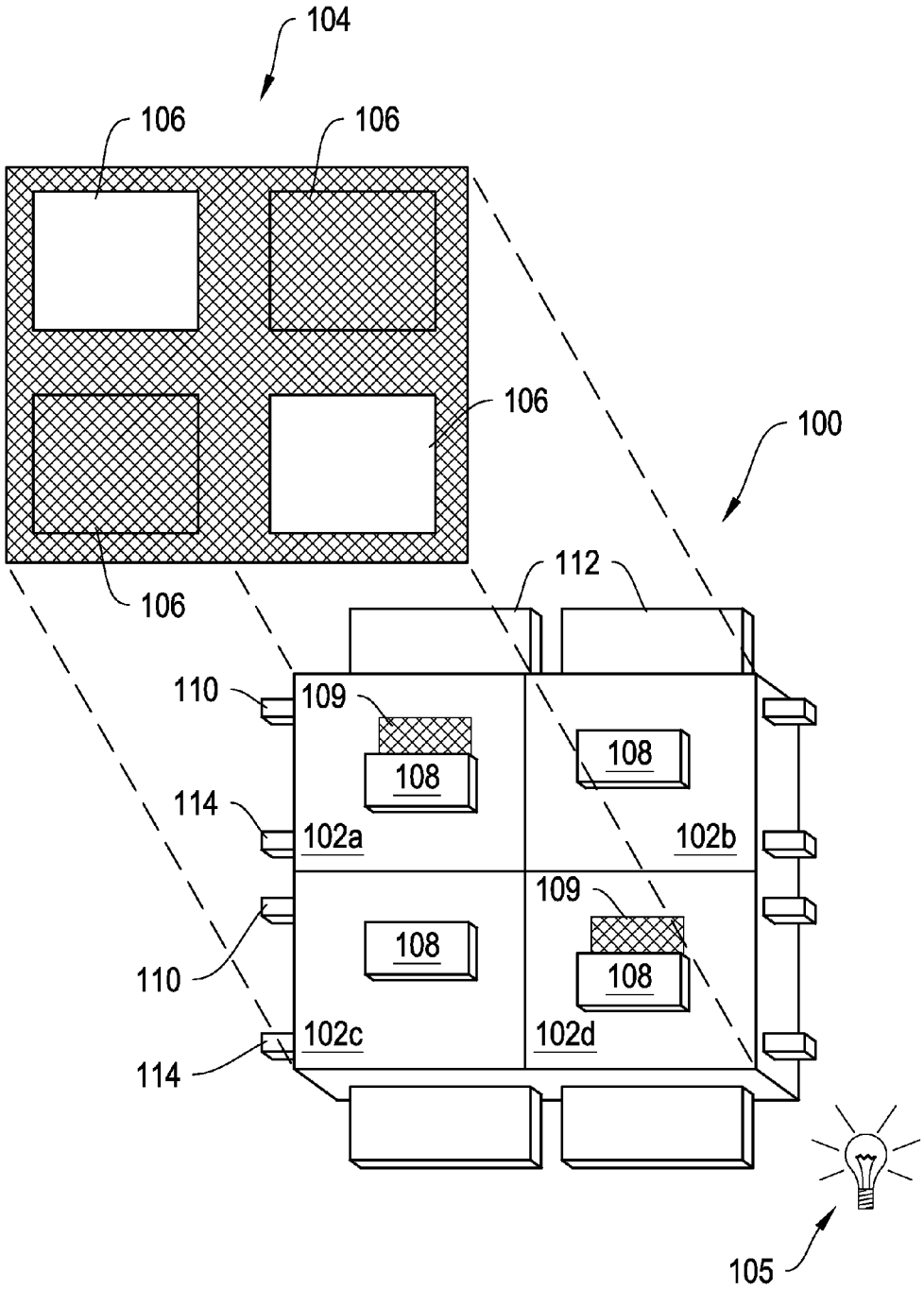
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that is capable of displaying an image, whether in motion (such as video) or stationary (such as still images), and whether textual, graphical or pictorial. The concepts and examples provided in this disclosure may be applicable to a variety of displays, such as liquid crystal displays (LCDs), organic light-emitting diode (OLED) displays, field emission displays, and electromechanical systems (EMS) and microelectromechanical (MEMS)-based displays, in addition to displays incorporating features from one or more display technologies.

The described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, wearable devices, clocks, calculators, television monitors, flat panel displays, electronic reading devices (such as e-readers), computer monitors, auto displays (such as odometer and speedometer displays), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, in addition to non-EMS applications), aesthetic structures (such as display of images on a piece of jewelry or clothing) and a variety of EMS devices.

The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A multi-primary display can include control logic that converts input image data into a multi-primary color space employed by the display by mapping the input pixel values into an intermediary color space and then into color subfields associated with the display's primary colors. For example, such a process can be used to convert image frames encoded in a red (R), green (G), blue (B) (i.e., RGB) color space into a RGB white (W) (i.e., RGBW) color space through the XYZ color space. For example, pixel information for an image can be received as a stream of R, G, and B pixel intensity values. Those RGB pixel intensity values can be converted into respective X, Y, and Z color tristimulus values. The pixel color tristimulus values are processed according to one or more image processing algorithms (such as dithering), resulting in updated X, Y, and Z color tristimulus values for each pixel. The updated color tristimulus values for each pixel can then be converted into a set of R, G, B, and W intensity values to form R, G, B, and W color subfields for output by the display. In some implementations, a different color, such as cyan (C), yellow (Y), or magenta (M), is used instead of W for the fourth color subfield.

In some implementations, to maintain color fidelity and improve power efficiency, the control logic can employ an image saturation dependent gamut mapping process when converting input image pixel values into the XYZ color tristimulus space. In some implementations, the control logic determines an appropriate level of desaturation for the gamut mapping process on a frame-by-frame basis while ensuring image quality by iteratively updating a gamut mapping saturation parameter for each frame based on an evaluation of an average color difference between a current gamut mapped image and a losslessly gamut mapped version of the same image, or of an image from the same scene. In some implementations, the evaluated difference is a retinex measure. The gamut mapping saturation parameter can be updated until it converges, a fixed number times, or until a new video scene or still image is detected. In some implementations, to determine each of the gamut mapping saturation parameters used during the iterative process, the control logic employs a proportional-integral-derivative (PID) controller process so that the gamut mapping saturation parameter smoothly converges to a final value.

Particular implementations of the subject matter described in this disclosure can be implemented to realize one or more of the following potential advantages. Gamut mapping an image to a multi-primary color space based on an image dependent gamut mapping saturation parameter allows an appropriate amount of image luminance to be output through a color subfield associated with a power-efficient white light source. Efficiency gains can be increased by identifying gamut mapping saturation parameter values that may result in a technical loss of color fidelity, but which are still perceived by the Human Visual System (HVS) as having a high level of color fidelity. Doing so allows additional image luminance to be output using the power-efficient white light source than would be possible if the gamut mapping process only used lossless gamut mapping saturation values. This can result in a decrease in the overall power consumption of the display. Using a retinex measure to evaluate the level of color difference or color error introduced into an output image by using a lossy color gamut saturation parameter value allows for an effective assessment of the effect of color difference on the human visual system's perception of the output image. Use of a PID controller process to obtain a final gamut mapping saturation parameter results in a smooth convergence of the parameter, mitigating the risk of the repeated parameter change resulting in image artifacts. In some implementations, using a color other than white, for example cyan, as a fourth color subfield can provide an expanded color gamut, further improving image quality.

In addition, dither noise introduced through either vector error diffusion or single color subfield dithering tends to be dependent on the value of the saturation-dependent gamut mapping parameter employed in the gamut mapping process. Using higher saturation gamut mapping parameter values tends to result in lesser amounts of dither noise. As a result, selecting a lossy saturation-dependent gamut mapping parameter can result in both power efficiencies and a reduction in dither noise.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the image can be seen by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or backlight so that each pixel can be uniformly illuminated. Transmissive direct-view displays are often built onto transparent substrates to facilitate a sandwich assembly arrangement where one substrate, containing the light modulators, is positioned over the backlight. In some implementations, the transparent substrate can be a glass substrate (sometimes referred to as a glass plate or panel), or a plastic substrate. The glass substrate may be or include, for example, a borosilicate glass, wine glass, fused silica, a soda lime glass, quartz, artificial quartz, Pyrex, or other suitable glass material.

Each light modulator 102 can include a shutter 108 and an aperture 109. To illuminate a pixel 106 in the image 104, the shutter 108 is positioned such that it allows light to pass through the aperture 109. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix coupled to the substrate and to the light modulators for controlling the movement of the shutters. The control matrix includes a series of electrical interconnects (such as interconnects 110, 112 and 114), including at least one write-enable interconnect 110 (also referred to as a scan line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, $V_{WE}$), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate drive voltages, which are typically higher in magnitude than the data voltages, to the light modulators 102. The application of these drive voltages results in the electrostatic driven movement of the shutters 108.

The control matrix also may include, without limitation, circuitry, such as a transistor and a capacitor associated with each shutter assembly. In some implementations, the gate of each transistor can be electrically connected to a scan line interconnect. In some implementations, the source of each transistor can be electrically connected to a corresponding data interconnect. In some implementations, the drain of each transistor may be electrically connected in parallel to an electrode of a corresponding capacitor and to an electrode of a corresponding actuator. In some implementations, the other electrode of the capacitor and the actuator associated with each shutter assembly may be connected to a common or ground potential. In some other implementations, the transistor can be replaced with a semiconducting diode, or a metal-insulator-metal switching element.

Figure 1B:
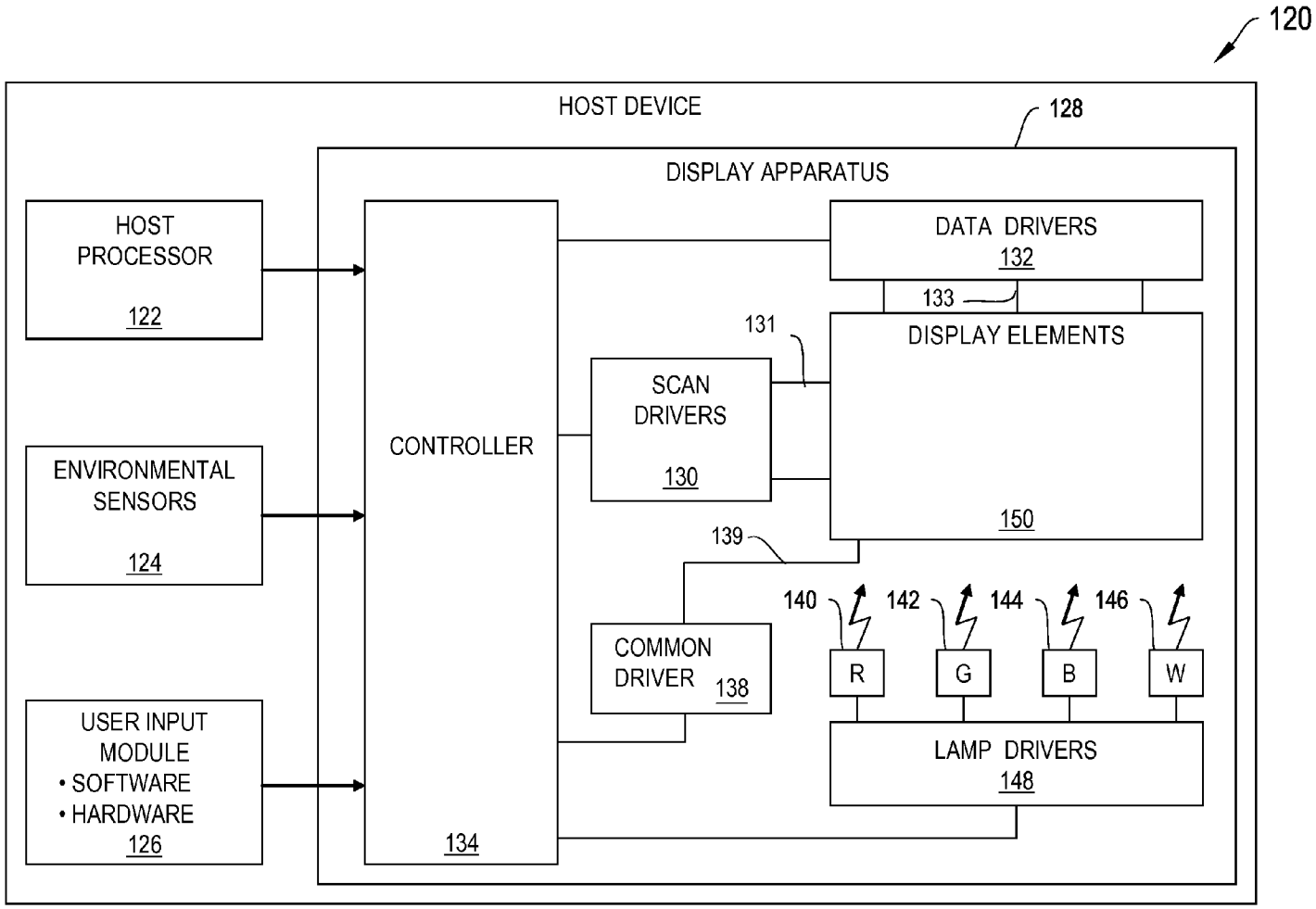
FIG. 1B shows a block diagram of an example host device.

FIG. 1B shows a block diagram of an example host device 120 (i.e., cell phone, smart phone, PDA, MP3 player, tablet, e-reader, netbook, notebook, watch, wearable device, laptop, television, or other electronic device). The host device 120 includes a display apparatus 128 (such as the display apparatus 100 shown in FIG. 1A), a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array of display elements 150, such as the light modulators 102 shown in FIG. 1A. The scan drivers 130 apply write enabling voltages to scan line interconnects 131. The data drivers 132 apply data voltages to the data interconnects 133.

In some implementations of the display apparatus, the data drivers 132 are capable of providing analog data voltages to the array of display elements 150, especially where the luminance level of the image is to be derived in analog fashion. In analog operation, the display elements are designed such that when a range of intermediate voltages is applied through the data interconnects 133, there results a range of intermediate illumination states or luminance levels in the resulting image. In some other implementations, the data drivers 132 are capable of applying a reduced set, such as 2, 3 or 4, of digital voltage levels to the data interconnects 133. In implementations in which the display elements are shutter-based light modulators, such as the light modulators 102 shown in FIG. 1A, these voltage levels are designed to set, in digital fashion, an open state, a closed state, or other discrete state to each of the shutters 108. In some implementations, the drivers are capable of switching between analog and digital modes.

The scan drivers 130 and the data drivers 132 are connected to a digital controller circuit 134 (also referred to as the controller 134). The controller 134 sends data to the data drivers 132 in a mostly serial fashion, organized in sequences, which in some implementations may be predetermined, grouped by rows and by image frames. The data drivers 132 can include series-to-parallel data converters, level-shifting, and for some applications digital-to-analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 139. In some other implementations, the common drivers 138, following commands from the controller 134, issue voltage pulses or signals to the array of display elements 150, for instance global actuation pulses which are capable of driving and/or initiating simultaneous actuation of all display elements in multiple rows and columns of the array.

Each of the drivers (such as scan drivers 130, data drivers 132 and common drivers 138) for different display functions can be time-synchronized by the controller 134. Timing commands from the controller 134 coordinate the illumination of red, green, blue and white lamps (140, 142, 144 and 146 respectively) via lamp drivers 148, the write-enabling and sequencing of specific rows within the array of display elements 150, the output of voltages from the data drivers 132, and the output of voltages that provide for display element actuation. In some implementations, the lamps are light emitting diodes (LEDs).

The controller 134 determines the sequencing or addressing scheme by which each of the display elements can be re-set to the illumination levels appropriate to a new image 104. New images 104 can be set at periodic intervals. For instance, for video displays, color images or frames of video are refreshed at frequencies ranging from 10 to 300 Hertz (Hz). In some implementations, the setting of an image frame to the array of display elements 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human visual system (HVS) will average the alternating frame images into the perception of an image having a broad and continuous range of colors. In some other implementations, the lamps can employ primary colors other than red, green, blue and white. In some implementations, fewer than four, or more than four lamps with primary colors can be employed in the display apparatus 128.

In some implementations, where the display apparatus 128 is designed for the digital switching of shutters, such as the shutters 108 shown in FIG. 1A, between open and closed states, the controller 134 forms an image by the method of time division gray scale. In some other implementations, the display apparatus 128 can provide gray scale through the use of multiple display elements per pixel.

In some implementations, the data for an image state is loaded by the controller 134 to the array of display elements 150 by a sequential addressing of individual rows, also referred to as scan lines. For each row or scan line in the sequence, the scan driver 130 applies a write-enable voltage to the write enable interconnect 131 for that row of the array of display elements 150, and subsequently the data driver 132 supplies data voltages, corresponding to desired shutter states, for each column in the selected row of the array. This addressing process can repeat until data has been loaded for all rows in the array of display elements 150. In some implementations, the sequence of selected rows for data loading is linear, proceeding from top to bottom in the array of display elements 150. In some other implementations, the sequence of selected rows is pseudo-randomized, in order to mitigate potential visual artifacts. And in some other implementations, the sequencing is organized by blocks, where, for a block, the data for a certain fraction of the image is loaded to the array of display elements 150. For example, the sequence can be implemented to address every fifth row of the array of the display elements 150 in sequence.

In some implementations, the addressing process for loading image data to the array of display elements 150 is separated in time from the process of actuating the display elements. In such an implementation, the array of display elements 150 may include data memory elements for each display element, and the control matrix may include a global actuation interconnect for carrying trigger signals, from the common driver 138, to initiate simultaneous actuation of the display elements according to data stored in the memory elements.

In some implementations, the array of display elements 150 and the control matrix that controls the display elements may be arranged in configurations other than rectangular rows and columns. For example, the display elements can be arranged in hexagonal arrays or curvilinear rows and columns.

The host processor 122 generally controls the operations of the host device 120. For example, the host processor 122 may be a general or special purpose processor for controlling a portable electronic device. With respect to the display apparatus 128, included within the host device 120, the host processor 122 outputs image data as well as additional data about the host device 120. Such information may include data from environmental sensors 124, such as ambient light or temperature; information about the host device 120, including, for example, an operating mode of the host or the amount of power remaining in the host device's power source; information about the content of the image data; information about the type of image data; and/or instructions for the display apparatus 128 for use in selecting an imaging mode.

In some implementations, the user input module 126 enables the conveyance of personal preferences of a user to the controller 134, either directly, or via the host processor 122. In some implementations, the user input module 126 is controlled by software in which a user inputs personal preferences, for example, color, contrast, power, brightness, content, and other display settings and parameters preferences. In some other implementations, the user input module 126 is controlled by hardware in which a user inputs personal preferences. In some implementations, the user may input these preferences via voice commands, one or more buttons, switches or dials, or with touch-capability. The plurality of data inputs to the controller 134 direct the controller to provide data to the various drivers 130, 132, 138 and 148 which correspond to optimal imaging characteristics.

The environmental sensor module 124 also can be included as part of the host device 120. The environmental sensor module 124 can be capable of receiving data about the ambient environment, such as temperature and or ambient lighting conditions. The sensor module 124 can be programmed, for example, to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2B:
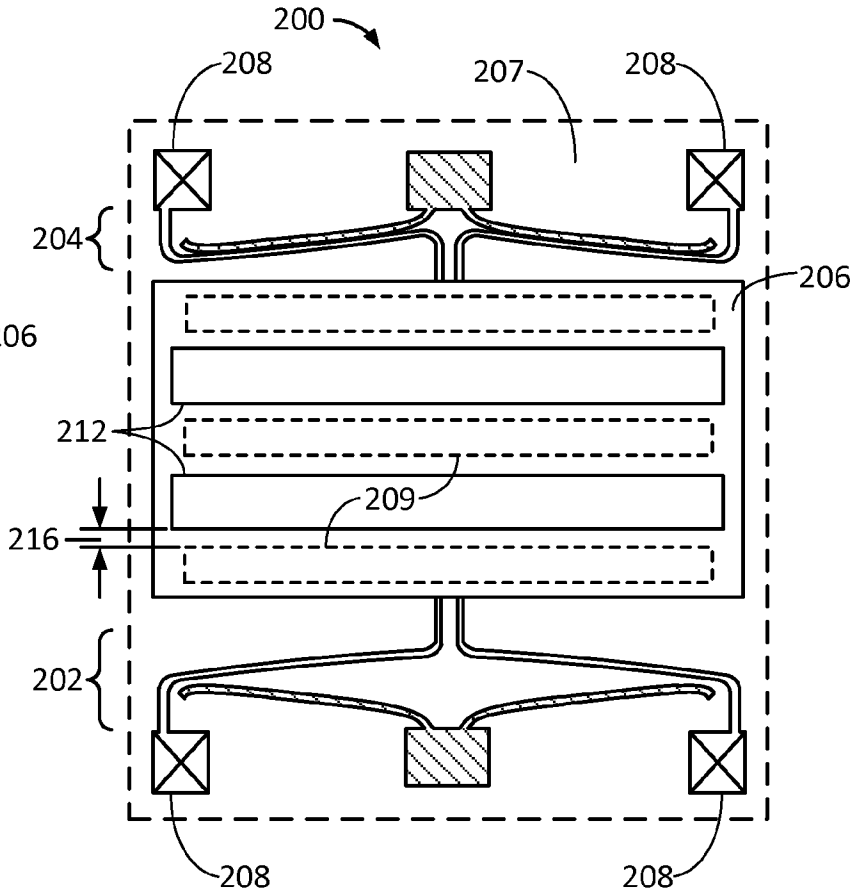
FIGS. 2A and 2B show views of an example dual actuator shutter assembly.
Figure 2A:
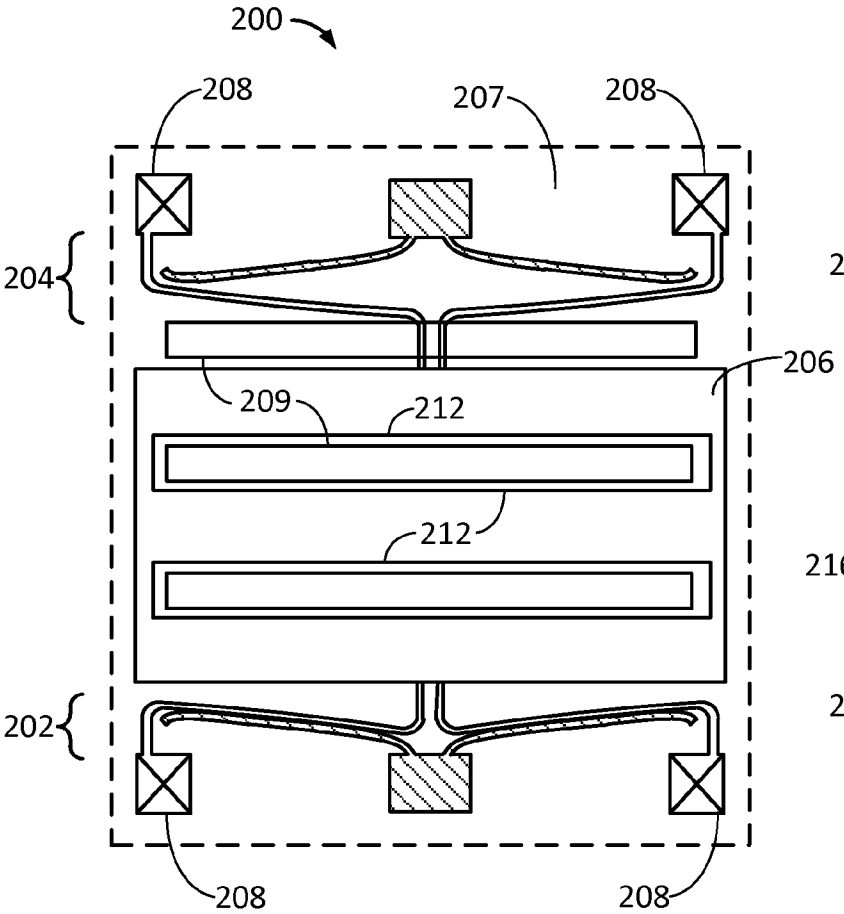

FIGS. 2A and 2B show views of an example dual actuator shutter assembly 200. The dual actuator shutter assembly 200, as depicted in FIG. 2A, is in an open state. FIG. 2B shows the dual actuator shutter assembly 200 in a closed state. The shutter assembly 200 includes actuators 202 and 204 on either side of a shutter 206. Each actuator 202 and 204 is independently controlled. A first actuator, a shutter-open actuator 202, serves to open the shutter 206. A second opposing actuator, the shutter-close actuator 204, serves to close the shutter 206. Each of the actuators 202 and 204 can be implemented as compliant beam electrode actuators. The actuators 202 and 204 open and close the shutter 206 by driving the shutter 206 substantially in a plane parallel to an aperture layer 207 over which the shutter is suspended. The shutter 206 is suspended a short distance over the aperture layer 207 by anchors 208 attached to the actuators 202 and 204. Having the actuators 202 and 204 attach to opposing ends of the shutter 206 along its axis of movement reduces out of plane motion of the shutter 206 and confines the motion substantially to a plane parallel to the substrate (not depicted).

In the depicted implementation, the shutter 206 includes two shutter apertures 212 through which light can pass. The aperture layer 207 includes a set of three apertures 209. In FIG. 2A, the shutter assembly 200 is in the open state and, as such, the shutter-open actuator 202 has been actuated, the shutter-close actuator 204 is in its relaxed position, and the centerlines of the shutter apertures 212 coincide with the centerlines of two of the aperture layer apertures 209. In FIG. 2B, the shutter assembly 200 has been moved to the closed state and, as such, the shutter-open actuator 202 is in its relaxed position, the shutter-close actuator 204 has been actuated, and the light blocking portions of the shutter 206 are now in position to block transmission of light through the apertures 209 (depicted as dotted lines).

Each aperture has at least one edge around its periphery. For example, the rectangular apertures 209 have four edges. In some implementations, in which circular, elliptical, oval, or other curved apertures are formed in the aperture layer 207, each aperture may have a single edge. In some other implementations, the apertures need not be separated or disjointed in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through the apertures 212 and 209 in the open state, the width or size of the shutter apertures 212 can be designed to be larger than a corresponding width or size of apertures 209 in the aperture layer 207. In order to effectively block light from escaping in the closed state, the light blocking portions of the shutter 206 can be designed to overlap the edges of the apertures 209. FIG. 2B shows an overlap 216, which in some implementations can be predefined, between the edge of light blocking portions in the shutter 206 and one edge of the aperture 209 formed in the aperture layer 207.

The electrostatic actuators 202 and 204 are designed so that their voltage-displacement behavior provides a bi-stable characteristic to the shutter assembly 200. For each of the shutter-open and shutter-close actuators, there exists a range of voltages below the actuation voltage, which if applied while that actuator is in the closed state (with the shutter being either open or closed), will hold the actuator closed and the shutter in position, even after a drive voltage is applied to the opposing actuator. The minimum voltage needed to maintain a shutter's position against such an opposing force is referred to as a maintenance voltage $V_m$.

Figure 3:
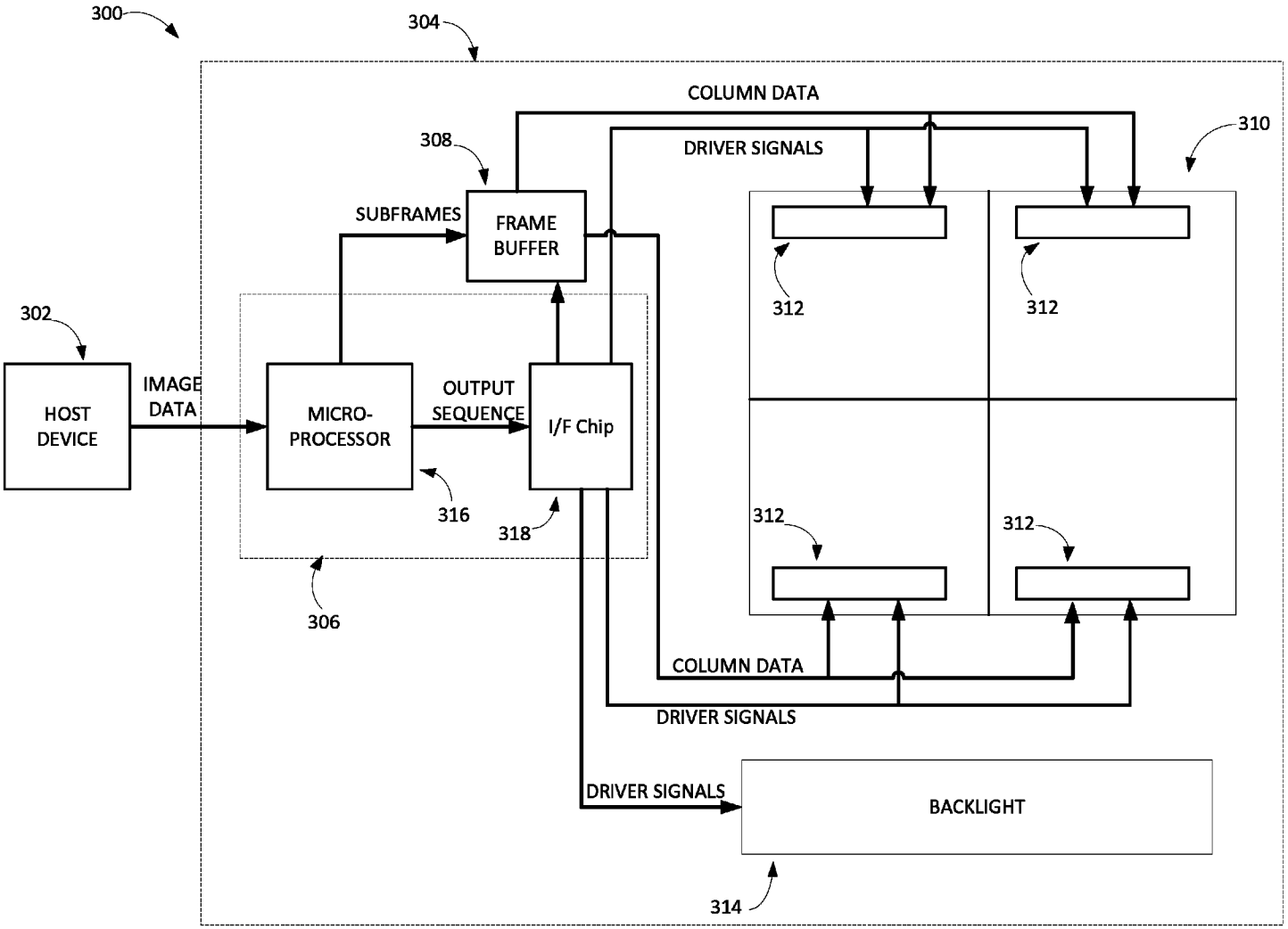
FIG. 3 shows a block diagram of an example display apparatus.

FIG. 3 shows a block diagram of an example display apparatus 300. The display apparatus 300 includes a host device 302 and a display module 304. The host device 302 can be an example of the host device 120 and the display module 304 can be an example of the display apparatus 128, both shown in FIG. 1B. The host device 302 can be any of a number of electronic devices, such as a portable telephone, a smartphone, a watch, a tablet computer, a laptop computer, a desktop computer, a television, a set top box, a DVD or other media player, or any other device that provides graphical output to a display, similar to the display device 40 shown in FIGS. 9A and 9B below. In general, the host device 302 serves as a source for image data to be displayed on the display module 304.

The display module 304 further includes control logic 306, a frame buffer 308, an array of display elements 310, display drivers 312 and a backlight 314. In general, the control logic 306 serves to process image data received from the host device 302 and controls the display drivers 312, array of display elements 310 and backlight 314 to together produce the images encoded in the image data. The control logic 306, frame buffer 308, array of display elements 310, and display drivers 312 shown in FIG. 3 can be similar, in some implementations, to the driver controller 29, frame buffer 28, display array 30, and array drivers 22 shown in FIGS. 9A and 9B, below. The functionality of the control logic 306 is described further below in relation to FIGS. 5-8.

In some implementations, as shown in FIG. 3, the functionality of the control logic 306 is divided between a microprocessor 316 and an interface (I/F) chip 318. In some implementations, the interface chip 318 is implemented in an integrated circuit logic device, such as an application specific integrated circuit (ASIC). In some implementations, the microprocessor 316 is configured to carry out all or substantially all of the image processing functionality of the control logic 306. In addition, the microprocessor 316 can be configured to determine an appropriate output sequence for the display module 304 to use to generate received images. For example, the microprocessor 316 can be configured to convert image frames included in the received image data into a set of image subframes. Each image subframe can be associated with a color and a weight, and includes desired states of each of the display elements in the array of display elements 310. The microprocessor 316 also can be configured to determine the number of image subframes to display to produce a given image frame, the order in which the image subframes are to be displayed, timing parameters associated with addressing the display elements in each subframe, and parameters associated with implementing the appropriate weight for each of the image subframes. These parameters may include, in various implementations, the duration for which each of the respective image subframes is to be illuminated and the intensity of such illumination. The collection of these parameters (i.e., the number of subframes, the order and timing of their output, and their weight implementation parameters for each subframe) can be referred to as an "output sequence."

The interface chip 318 can be capable of carrying out more routine operations of the display module 304. The operations may include retrieving image subframes from the frame buffer 308 and outputting control signals to the display drivers 312 and the backlight 314 in response to the retrieved image subframe and the output sequence determined by the microprocessor 316. In some other implementations, the functionality of the microprocessor 316 and the interface chip 318 are combined into a single logic device, which may take the form of a microprocessor, an ASIC, a field programmable gate array (FPGA) or other programmable logic device. For example, the functionality of the microprocessor 316 and the interface chip 318 can be implemented by a processor 21 shown in FIG. 9B. In some other implementations, the functionality of the microprocessor 316 and the interface chip 318 may be divided in other ways between multiple logic devices, including one or more microprocessors, ASICs, FPGAs, digital signal processors (DSPs) or other logic devices.

Figure 9A:
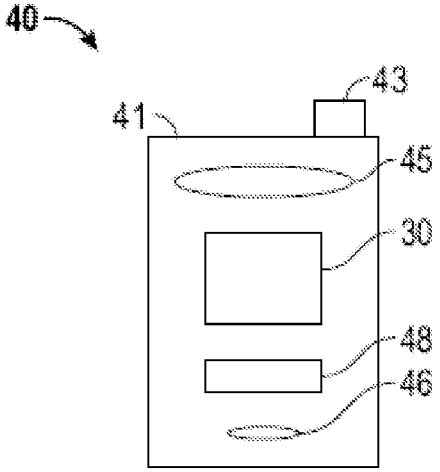
FIGS. 9A and 9B show system block diagrams of an example display device that includes a plurality of display elements.
Figure 9B:
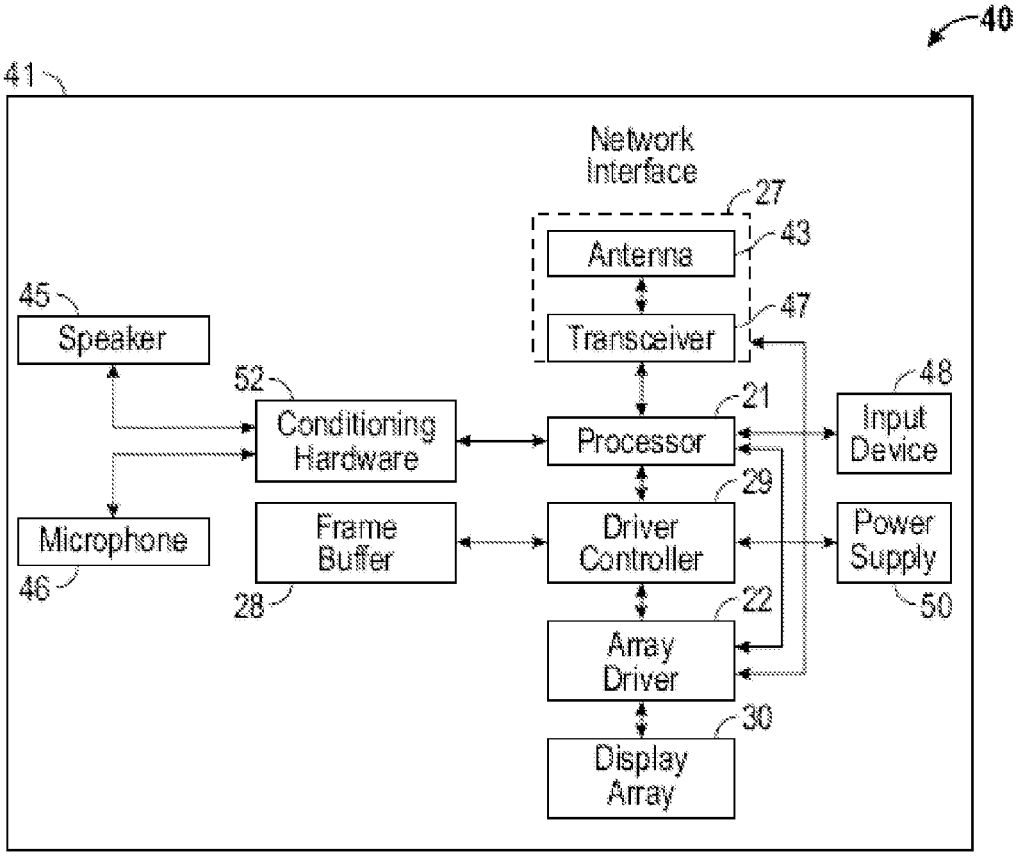

The frame buffer 308 can be any volatile or non-volatile integrated circuit memory, such as DRAM, high-speed cache memory, or flash memory (for example, the frame buffer 308 can be similar to the frame buffer 28 shown in FIG. 9B). In some other implementations, the interface chip 318 causes the frame buffer 308 to output data signals directly to the display drivers 312. The frame buffer 308 has sufficient capacity to store color subfield data and subframe data associated with at least one image frame. In some implementations, the frame buffer 308 has sufficient capacity to store color subfield data and subframe data associated with a single image frame. In some other implementations, the frame buffer 308 has sufficient capacity to store color subfield data and subframe data associated with at least two image frames. Such extra memory capacity allows for additional processing by the microprocessor 316 of image data associated with a more recently received image frame while a previously received image frame is being displayed via the array of display elements 310.

In some implementations, the display module 304 includes multiple memory devices. For example, the display module 304 may include one memory device, such as a memory directly associated with the microprocessor 316, for storing subfield data, and the frame buffer 308 is reserved for storage of subframe data.

The array of display elements 310 can include an array of any type of display elements that can be used for image formation. In some implementations, the display elements can be EMS light modulators. In some such implementations, the display elements can be MEMS shutter-based light modulators similar to those shown in FIG. 2A or 2B. In some other implementations, the display elements can be other forms of light modulators, including liquid crystal light modulators, other types of EMS- or MEMS-based light modulators, or light emitters, such as OLED emitters, configured for use with a time division gray scale image formation process.

The display drivers 312 can include a variety of drivers depending on the specific control matrix used to control the display elements in the array of display elements 310. In some implementations, the display drivers 312 include a plurality of scan drivers similar to the scan drivers 130, a plurality of data drivers similar to the data drivers 132, and a set of common drivers similar to the common drivers 138, as shown in FIG. 1B. As described above, the scan drivers output write enabling voltages to rows of display elements, while the data drivers output data signals along columns of display elements. The common drivers output signals to display elements in multiple rows and multiple columns of display elements.

In some implementations, particularly for larger display modules 304, the control matrix used to control the display elements in the array of display elements 310 is segmented into multiple regions. For example, the array of display elements 310 shown in FIG. 3 is segmented into four quadrants. A separate set of display drivers 312 is coupled to each quadrant. Dividing a display into segments in this fashion can reduce the propagation time needed for signals output by the display drivers to reach the furthest display element coupled to a given driver, thereby decreasing the time needed to address the display. Such segmentation also can reduce the power requirements of the drivers employed.

In some implementations, the display elements in the array of display elements can be utilized in a direct-view transmissive display. In direct-view transmissive displays, the display elements, such as EMS light modulators, selectively block light that originates from a backlight, such as the backlight 314, which is illuminated by one or more lamps. Such display elements can be fabricated on transparent substrates, made, for example, from glass. In some implementations, the display drivers 312 are coupled directly to the glass substrate on which the display elements are formed. In such implementations, the drivers are built using a chip-on-glass configuration. In some other implementations, the drivers are built on a separate circuit board and the outputs of the drivers are coupled to the substrate using, for example, flex cables or other wiring.

The backlight 314 can include a light guide, one or more light sources (such as LEDs), and light source drivers. The light sources can include light sources of multiple colors, such as red, green, blue, and in some implementations white. The light source drivers are capable of individually driving the light sources to a plurality of discrete light levels to enable illumination gray scale and/or content adaptive backlight control (CABC) in the backlight. In addition, lights of multiple colors can be illuminated simultaneously at various intensity levels to adjust the chromaticities of the component colors used by the display, for example to match a desired color gamut. Lights of multiple colors also can be illuminated to form composite colors. For displays employing red, green, and blue component colors, the display may utilize a composite color white, yellow, cyan, magenta, or any other color formed from a combination of two or more of the component colors.

The light guide distributes the light output by light sources substantially evenly beneath the array of display elements 310. In some other implementations, for example for displays including reflective display elements, the display apparatus 300 can include a front light or other form of lighting instead of a backlight. The illumination of such alternative light sources can likewise be controlled according to illumination gray scale processes that incorporate content adaptive control features. For ease of explanation, the display processes discussed herein are described with respect to the use of a backlight. However, it would be understood by a person of ordinary skill that such processes also may be adapted for use with a front light or other similar form of display lighting.

Figure 4:
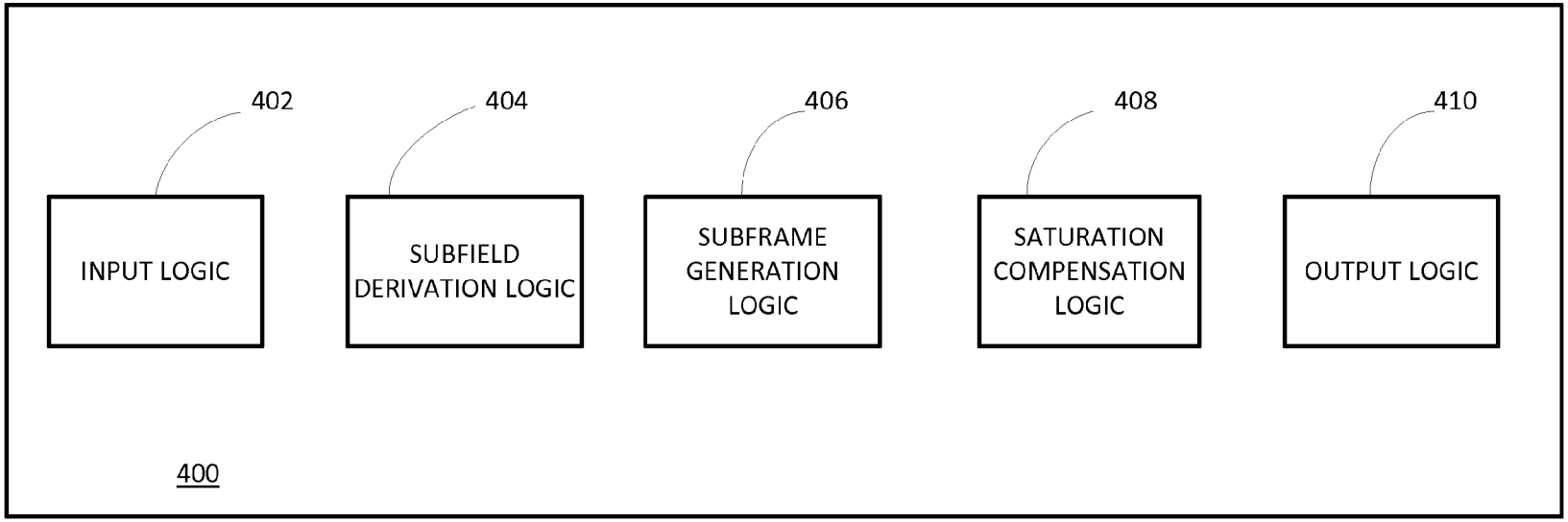
FIG. 4 shows a block diagram of example control logic suitable for use as, for example, the control logic in the display apparatus shown in FIG. 3.

FIG. 4 shows a block diagram of example control logic 400 suitable for use as, for example, the control logic 306 in the display apparatus 300 shown in FIG. 3. More particularly, FIG. 4 shows a block diagram of functional modules executed by the microprocessor 316 and the I/F Chip 318 or by other integrated circuitry logic forming or included in the control logic 400. Each functional module can be implemented as software in the form of computer executable instructions stored on a tangible computer readable medium, which can be executed by the microprocessor 316 and/or as logic circuitry incorporated into the I/F Chip 318. In some implementations, the functionality of each module described below is designed to increase the amount of the functionality that can be implemented in integrated circuit logic, such as an ASIC, in some cases substantially eliminating or eliminating altogether the need for the microprocessor 316.

The control logic 400 includes input logic 402, subfield derivation logic 404, subframe generation logic 406, saturation compensation logic 408, and output logic 410. Generally, the input logic 402 receives input images for display. The subfield derivation logic 404 converts the received image frames into color subfields. The subframe generation logic 406 converts color subfields into a series of subframes that can be directly loaded into an array of display elements, such as the display elements 310 shown in FIG. 3. The saturation compensation logic 408 evaluates the contents of a received image frame and provides image saturation-based conversion parameters to the subfield derivation logic 404 and the subfield generation logic 406. The output logic 410 controls the loading of the generated subframes into an array of display elements, such as the display elements 310 shown in FIG. 3, and controls the illumination of a backlight, such as the backlight 314, also shown in FIG. 3, to illuminate and display the subframes. While shown as separate functional modules in FIG. 4, in some implementations, the functionality of two or more of the modules may be combined into one or more larger, more comprehensive modules, or divided into smaller, more discrete modules. Together the components of the control logic 400 function to carry out a method for generating an image on a display.

Figure 5:
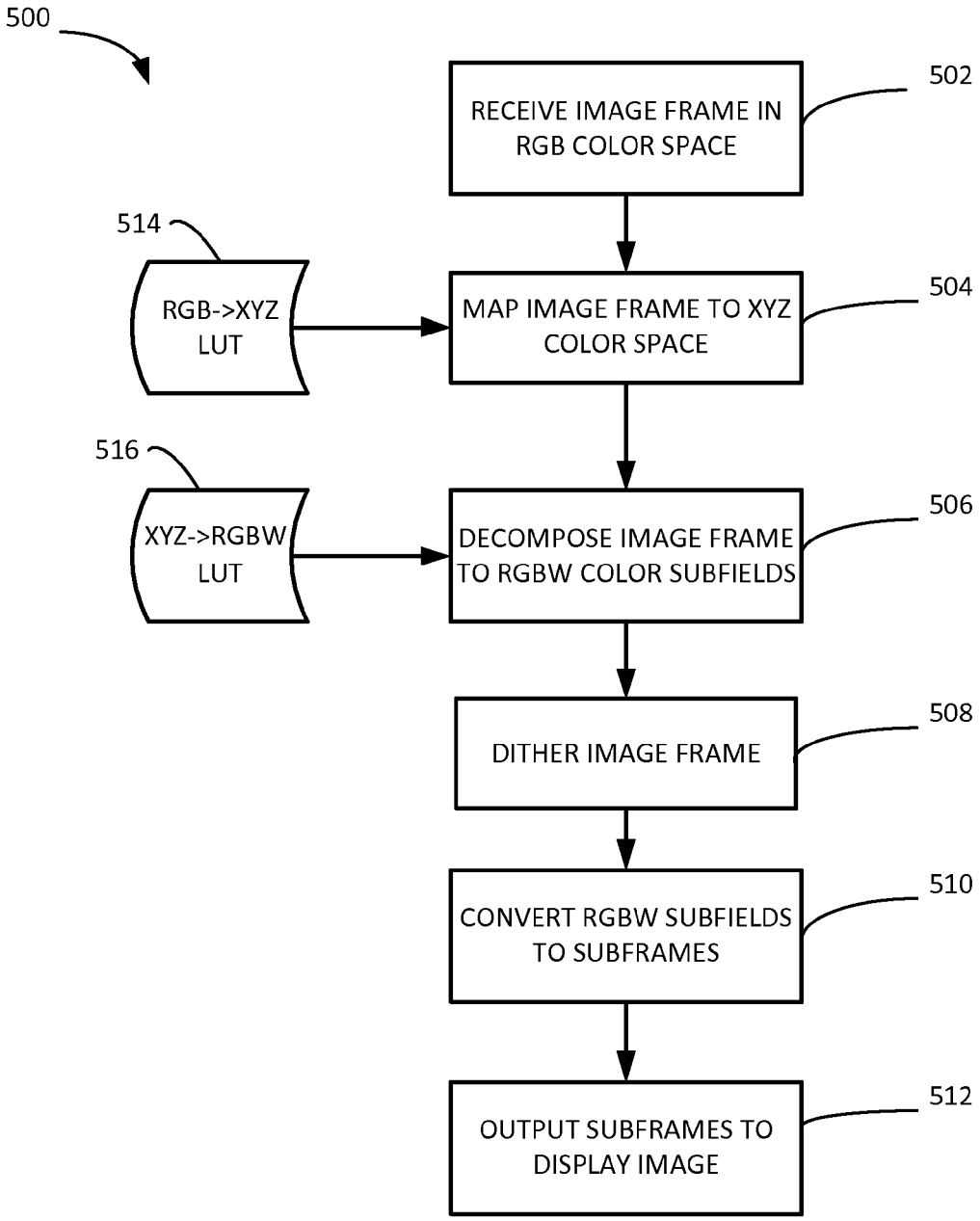
FIGS. 5-8 show flow diagrams of example processes for generating an image on a display using the control logic shown in FIG. 4.
Figure 6:
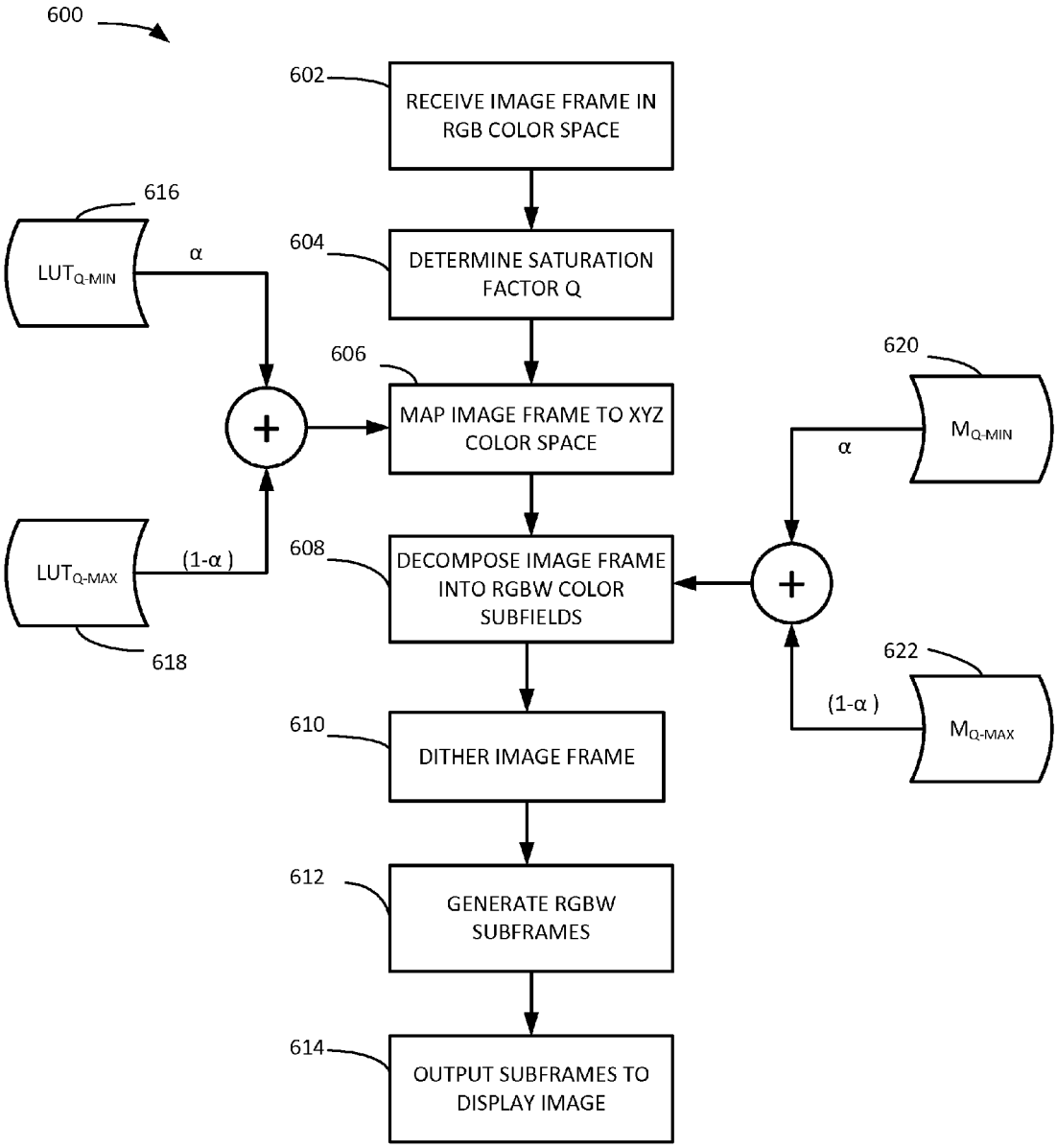

FIG. 5 shows a flow diagram of an example process 500 for generating an image on a display using the control logic 400 shown in FIG. 4. The process 500 includes receiving an image frame (stage 502), mapping the received image frame to the XYZ color space (stage 504), decomposing the image frame from the XYZ color space into red (R), green (G), blue (B), and white (W) color subfields (stage 506), dithering the image frame (stage 508), generating subframes for each of the color subfields (stage 510), and displaying the subframes to output the image (stage 512). In some implementations, the process 500 displays images without the use of the saturation compensation logic 408. A process using the saturation compensation logic 408 is shown in FIG. 6.

Referring to FIGS. 4 and 5, the process 500 includes the input logic 402 receiving data associated with an image frame (stage 502). Typically, such image data is obtained as a stream of intensity values for the red, green, and blue components of each pixel in the image frame. The intensity values typically are received as binary numbers. The received data is stored as an input set of RGB color subfields. Each color subfield includes for each pixel in the display an intensity value indicating the amount of light to be transmitted by that pixel, for that color, to form the image frame. In some implementations, the input logic 402 and/or the subfield derivation logic 404 derives the input set of component color subfields by segregating the pixel intensity values for each primary color represented in the received image data (typically red, green, and blue) into respective subfields. In some implementations, one or more image pre-processing operations, such as gamma correction and dithering, also may be carried out by the input logic 402 and/or the subfield derivation logic 404 prior to, or in the process of, deriving the input set of color subfields.

The subfield derivation logic 404 converts the input set of color subfields into the XYZ color space (stage 504). To expedite the conversion process, the subfield derivation logic can employ a three-dimensional LUT, in which the intensity values of the respective input color subfields serve as the index into the LUT. Each triplet of {R,G,B} intensity values is mapped to a corresponding vector in the XYZ color space. The LUT is referred to as a RGB→XYZ LUT 514. The RGB→XYZ LUT 514 can be stored in memory incorporated into the control logic 400, or it can be stored in memory external to, but accessible by, the control logic 400. In some implementations, the subfield derivation logic 404 can separately calculate XYZ tristimulus values for each pixel using a conversion matrix matched to the color gamut used to encode the image frame.

The subfield derivation logic 404 converts the pixel values in the XYZ tristimulus color space into red (R), green (G), blue (B), and white (W) subfields (or RGBW subfields) (stage 506). The subfield derivation logic applies a decomposition matrix M, which is defined as follows:

$$M = \begin{bmatrix} X_r^{subfield} & X_g^{subfield} & X_b^{subfield} & X_w^{subfield} \\ Y_r^{subfield} & Y_g^{subfield} & Y_b^{subfield} & Y_w^{subfield} \\ Z_r^{subfield} & Z_g^{subfield} & Z_b^{subfield} & Z_w^{subfield} \end{bmatrix}$$

where $X_r^{subfield}$, $Y_r^{subfield}$, and $Z_r^{subfield}$ correspond to the XYZ tristimulus values of the color of the light used to illuminated subframes associated with the red subfield, $X_g^{subfield}$, $Y_g^{subfield}$, and $Z_g^{subfield}$ correspond to the XYZ tristimulus values of the color of the light used to illuminated subframes associated with the green subfield, $X_b^{subfield}$, $Y_b^{subfield}$, and $Z_b^{subfield}$ and correspond to the XYZ tristimulus values of the color of the light used to illuminated subframes associated with the blue subfield, and $X_w^{subfield}$, $Y_w^{subfield}$, and $Z_w^{subfield}$ correspond to the XYZ tristimulus values of the color of the light used to illuminated subframes associated with the white subfield. Each pixel value in the RGBW space is equal to:

$$\begin{bmatrix} R \\ G \\ B \\ W \end{bmatrix} = f\left\{\begin{bmatrix} X \\ Y \\ Z \end{bmatrix}, M\right\},$$

where f is some decomposition procedure involving the decomposition matrix M and the desired tristimulus value XYZ.

In some implementations, instead of applying a decomposition matrix, the subfield derivation logic 404 utilizes a XYZ→RGBW LUT 516, which is stored by or is accessible by the subfield derivation logic 404. The XYZ→RGBW LUT 516 maps each XYZ tristimulus value triplet to a set of RGBW pixel intensity values.

In some implementations, the control logic 400 displays images using what is referred to as a multi-primary display process. A multi-primary display process utilizes more than three primary colors to form an image, and the sum of the XYZ tristimulus values of the primary colors equals the display XYZ tristimulus values of the gamut white point. This is in contrast to some other display processes that utilize more than three primary colors in which the sum of the primaries do not equal the white point. For example, in some display processes using red, green, blue, and white color subfields, the red, green, and blue color primaries sum to the display white point of the gamut, and the luminance provided through the white subfield is in addition to that combined luminance. That is, if all RGBW primaries were illuminated at full strength, the total illumination would have twice the luminance of the gamut white point. As such, in some implementations, the XYZ values referred to above for each of the display primaries, red, green, blue and white, sum up to XYZ tristimulus values of the white point of the gamut being displayed.

In some implementations, the display outputs an image (stage 512) using a different number of subframes for each subfield. As such, the pixel intensity values within the RGBW subfields are adjusted such that the values can be displayed with the respective allocated number of subframes for each subfield. Such adjustments can introduce quantization errors which can reduce image quality. The subfield derivation logic 404 executes a dithering process to mitigate such quantization errors (stage 508).

In some implementations, each RGBW subfield is dithered separately in the RGBW color space. In some other implementations, the RGBW subfields are collectively processed by a vector error diffusion-based dithering algorithm. In some implementations, such vector error diffusion-based dithering is carried out in the XYZ color space. In some implementations, therefore, the dithering is carried out prior to conversion of the XYZ pixel values into the RGBW subfields. In vector error diffusion, since errors are diffused in the XYZ space, errors with respect to any one color can be diffused across all colors through direct adjustment to chromaticity or luminance values of the pixels. In contrast, dithering in the RGB or RGBW color space diffuses error in a color across other pixels within the same color subfield. In some implementations, the dithering (stage 508) and the conversion of the image frame into RGBW subfields (stage 506) can be combined into a unified process.

Referring back to FIGS. 4 and 5, the subframe generation logic 406 processes the RGBW subfields to generate sets of subframes (stage 510). Each subframe corresponds to a particular time slot in a time division gray scale image output sequence. It includes a desired state of each display element in the display for that time slot. In each time slot, a display element can take either a non-transmissive state or one or more states that allow for varying degrees of light transmission. In some implementations, the generated subframes include a distinct state value for each display element in the array of display elements 310 shown in FIG. 3.

In some implementations, the subframe generation logic 406 uses a code word LUT to generate the subframes (stage 510). In some implementations, the code word LUT stores a series of binary values referred to as code words that indicate corresponding series of display element states that result in given pixel intensity values. The value of each digit in the code word indicates a display element state (for example, light or dark, or open or close) and the position of the digit in the code word represents the weight that is to be attributed to the state. In some implementations, the weights are assigned to each digit in the code word such that each digit is assigned a weight that is twice the weight of a preceding digit. In some other implementations, multiple digits of a code word may be assigned the same weight. In some other implementations, each digit is assigned a different weight, but the weights may not all increase according to a fixed pattern, digit to digit.

To generate a set of subframes (stage 510), the subframe generation logic 406 obtains code words for all pixels in a color subfield. The subframe generation logic 406 can aggregate the digits in each of the respective positions in the code words for the set of pixels in the subfield together into subframes. For example, the digits in the first position of each code word for each pixel are aggregated into a first subframe. The digits in the second position of each code word for each pixel are aggregated into a second subframe, and so forth. The subframes, once generated, are stored in the frame buffer 308 shown in FIG. 3.

In some other implementations, for example in implementations using light modulators capable of achieving one or more partially transmissive states, the code word LUT may store code words using base-3, base-4, base-10, or some other base number scheme.

The output logic 410 of the control logic 400 (shown in FIG. 4) can output the generated subframes to display the received image frame (stage 512). Similar to as described above in relation to FIG. 3 with respect to the I/F chip 318, the output logic 410 causes each subframe to be loaded into the array of display elements 310 (shown in FIG. 3) and to be illuminated according to an output sequence. In some implementations, the output sequence is capable of being configured, and may be modified based on user preferences, the content of image data being displayed, external environmental factors, etc.

By displaying some amount of image luminance through a white subfield, which can be illuminated by a higher efficiency white light source, such as a white LED, the process 500 can improve the energy efficiency of a display. Given that the process 500 uses a single set of tristimulus values for each of the subfields being display, the process is computationally efficient, but image quality may be reduced when reproducing certain images. In some implementations, energy efficiency also may suffer. For example, assuming a non-negligible portion of image luminance is pushed to the white subfield, images with highly saturated colors may appear washed out.

FIG. 6 shows a flow diagram of another example process 600 for generating an image on a display using the control logic 400 shown in FIG. 4. The process 600 utilizes the saturation compensation logic 408 to mitigate the image quality issues that can arise with the display process 500 depicted in FIG. 5. More particularly, the process 600 adjusts the manner in which input pixel values are converted to the XYZ color space and the manner in which pixel values in the XYZ color space are converted into pixel values in RGBW subfields based on a saturation metric, Q, which can be determined, in some implementations, for each image frame. In some implementations, such as for video images, a single Q value can be determined based on a first image frame in a scene and can be used for subsequent image frames until a scene change is detected. The process 600 includes receiving an image frame in the RGB color space (stage 602), determining a saturation factor, Q, for the image frame (stage 604), mapping the pixel values in the image frame to the XYZ color space based on Q (stage 606), decomposing the image frame in the XYZ color space into RGBW subfields (stage 608), dithering the image frame (stage 610), generating RGBW subframes (stage 612) and outputting the subframes to display the image (stage 614).

The process 600 includes receiving an image frame in the RGB color space (stage 602) in the form of a stream of RGB pixel values as described above in relation to stage 502 shown in FIG. 5. As described with respect to stage 502, stage 602 can include pre-processing the pixel values and storing the results in a set of input RGB color subfields.

The saturation compensation logic 408 shown in FIG. 4 processes the image frame to determine a saturation factor Q for the image frame (stage 604). The Q parameter corresponds to the relative size of the output color gamut to the input color gamut. Viewed another way, Q represents the degree to which an image's luminance will be output by the display through the white subfield, relative to the red, green, and blue subfields. In general, as the Q value increases, the size of the color gamut output by the display shrinks. The shrinkage can be the result of the intensities of the subfield colors being reduced while their chromaticities remain fixed. For example, a Q value of 1.0 corresponds to a black and white image, as all display luminance is output in the white subfield. A Q value of 0.0 corresponds to a fully saturated color gamut formed purely by red, green, and blue color fields, without any luminance being transferred to a white subfield. Images including highly saturated colors can be more faithfully represented with low values of Q, whereas as images with large amounts of white content (for example, word processing documents and many web pages) can be displayed with higher values of Q without a perceptually significant decrease in image quality, and while obtaining significant power savings. Accordingly Q is selected to be large for images that include largely unsaturated colors, whereas low Q values are selected for images that include highly saturated colors. In some implementations, the Q value can be obtained by taking histogram data associated with the input pixel values and using some or all of the histogram data as an index into a Q value LUT. In some implementations, the set of input RGB color subfields are analyzed to determine the maximum white intensity value that can be extracted from all pixels in the image frame without introducing color error. In some such implementations, Q is calculated as follows:

$$Q = \frac{\mathrm{Min}_{all\ pixels}(\mathrm{Min}_{pixel}(R, G, B))}{Maxintensity},$$

where MaxIntensity corresponds to the maximum intensity value possible in a subfield (such as 255 in an 8-bit subfield).

In some other implementations, Q can be calculated in the XYZ color space. In such implementations, $Q_s$ can be determined by identifying the size of a minimum bounding hexagon which can enclose all XYZ pixel values included in input image projected to a common plane normal to an XYZ color space central axis connecting the XYZ values of black (at the origin) and pure white (such as XYZ values of 0.9502, 1.0, 1.0884). Q is set equal to the difference between 1.0 and the ratio of the size of the bounding hexagon and the hexagon that would result from capturing the full display color gamut (such as the sRGB, Adobe RGB color gamut, or the rec.2020 color gamut).

Based on the determined Q value, the pixel values stored in the input set of RGB color subfields are mapped to the XYZ color space (stage 606). As indicated above, as more image luminance is output through a white subfield as Q increases, rather than through the red, green, and blue subfields, the gamut of the output image is decreased. To maintain image quality, i.e., to maintain an appropriate color balance given the selected saturation level, pixel values are converted to the XYZ color space using gamut mapping algorithms tailored to the reduced output gamuts.

In some implementations, RGB values can be converted to the XYZ color space by multiplying a set of RGB pixel values by a Q-dependent color transform matrix. In some other implementations, to increase the speed of the conversion, three-dimensional Q-dependent RGB→XYZ LUTs can be stored by (or may be accessible by) the saturation compensation logic 408, indexed by {R,G,B} triplet values. Storing a large number of such LUTs, may, for some implementations, become prohibitive from a memory capacity standpoint. To ameliorate the memory capacity concerns associated with storing a large number of Q-dependent RGB→XYZ LUTs, the saturation compensation logic 408 may store a relatively small number of Q-dependent RGB→XYZ LUTs, and use interpolation between the LUTs for Q values other than those associated with the stored LUTs.

FIG. 6 shows one such implementation. The process 600 shown in FIG. 6 utilizes two Q-dependent RGB→XYZ LUTs, i.e., a $Q_{min}$ LUT 616 and a $Q_{max}$ LUT 618. The $Q_{min}$ LUT 616 is a RGB→XYZ LUTs based on the lowest value of Q used by the control logic 400. The $Q_{max}$ LUT 618 is a RGB→XYZ LUTs based on the highest value of Q used by the control logic 400. In some implementations, the minimum Q value ranges from about 0.01 to about 0.2, and the maximum Q value ranges from about 0.4 to about 0.8. In some implementations, the maximum Q value can range up to 1.0. In some implementations, more than two Q-dependent RGB→XYZ LUTs can be employed for more accurate interpolation. For example, in some implementations, the process 600 can use RGB→XYZ LUTs for Q values of 0.0, 0.5, and 1.0.

To carry out the interpolation, the saturation compensation logic 408 can calculate a scaling factor α, as follows:

$$\alpha = \frac{Q_{MAX} - Q}{Q_{MAX} - Q_{MIN}}.$$

As the XYZ color space is linear, the XYZ tristimulus values for any RGB input pixel value with any Q values between $Q_{min}$ and $Q_{max}$ can be calculated to be equal to:

$$\alpha LUT_{Q\text{-}min}(\text{RGB})+(1-\alpha)LUT_{Q\text{-}max}(\text{RGB}),$$

where LUT(RGB) represents the output of an LUT for a given RGB input pixel value. In some implementations, instead of carrying out two lookup functions for each pixel value, the saturation compensation logic 408 generates a new RGB→XYZ LUTs for each image frame (or each time Q changes between image frames), combining the $Q_{min}$ LUT and a $Q_{max}$ LUT according to a similar equation for determining the XYZ tristimulus values for a given RGB input pixel value. That is:

$$LUT_Q=\alpha LUT_{Q\text{-}min}+(1-\alpha)LUT_{Q\text{-}max}.$$

Once the image pixel values are in the XYZ tristimulus space, the subfield derivation logic 404 decomposes the pixel values into a set of RGBW color subfields (stage 608). Similar to the pixel decomposition stage (stage 506) shown in FIG. 5, in stage 608, the subfield derivation logic 404 decomposes each pixel value using a decomposition matrix. In stage 608, however, the subfield derivation logic 404 uses a Q-dependent decomposition matrix $M_Q$. The Q-dependent decomposition matrix, $M_Q$, has the same form as the decomposition matrix M, other than the XYZ values associated with each subfield vary based on the value of Q selected.

In some implementations, the saturation compensation logic 408 stores, or has access to, a set of decomposition matrices for a large range of Q values. In some other implementations, to save memory, as with the RGB→XYZ LUTs, the control logic 400 can store or access a more limited set of decomposition matrices, $M_Q$, with matrices for other values being calculated via interpolation. For example, the control logic may store or access a first decomposition matrix, $M_{Q\text{-}min}$ 620 and a second decomposition matrix, $M_{Q\text{-}max}$ 622. Decomposition matrices for values of Q between $Q_{min}$ and $Q_{max}$ can be calculated as follows:

$$M_Q=\alpha M_{Q\text{-}min}+(1-\alpha)M_{Q\text{-}max}.$$

In some other implementations, instead of using a Q-dependent decomposition matrix in stage 608, the subfield derivation logic 404 instead utilizes a Q-dependent XYZ→RGBW LUT. As with the Q-dependent RGB→XYZ LUTs, the subfield derivation logic 404 can store or have access to a limited number of Q-dependent XYZ→RGBW LUTs. The subfield derivation logic 404 can then generate a frame-specific XYZ→RGBW LUT for the image frame based on its corresponding Q value through a similar interpolation process used to generate a Q-specific RGB→XYZ LUT.

In some other implementations, a LUT may not be used at all, and the XYZ to RGBW decomposition is derived directly first multiplying the XYZ pixel values by a matrix M' to obtain virtual primaries R' G' B' that enclose the display gamut for all Q. This matrix M' corresponds to $M_{Q=0}$, since the gamut for Q=0 encloses the gamut obtained for all Q>0. Intensity values for R,G,B and W are then obtained by by calculating:

$$W = \min\left\{\min\left\{\frac{1-Q}{Q}(R', G', B')\right\}, 1\right\}, \text{ and}$$

$$R, G, B = R', G', B' - \frac{1-Q}{Q}W.$$

The display process dithers the results of the pixel decomposition stage (stage 610) and generates a set of RGBW subframes from the results of the dithering (stage 612). The dithering stage (stage 610) and the subframe generation stage (stage 612) can be identical to the corresponding processing stages (stages 508 and 510) in the process 500 discussed in relation to FIG. 5.

The generated RGBW subframes are output to display an image (stage 614). In contrast to the output stage 512 shown in FIG. 5, the subframe output stage (stage 614) includes a light source intensity calculation process to adjust the intensities of the light sources based on the value of Q selected for the image frame. As indicated above, the selection of Q results in a modification to the display gamut, as such the light source intensities for each of the RGB subfields are adjusted to be less saturated as Q increases and the intensity of the white light source for the white subfield is increased as Q increases. In some implementations, the light source intensities are scaled linearly based on the value of Q. For example, with a Q of 0.5, the light source intensity values for each non-white subfield are multiplied by 0.5. If Q were 0.2, the light source intensity values for each non-white subfield would be multiplied by 0.8, and so forth. In some implementations, the light source intensity calculation can be carried out earlier in the process 600.

In the process 600 discussed above, the Q value utilized to output images can be considered a "lossless" Q value. That is, Q is selected such that the most saturated colors in the image frame can still be reproduced without being desaturated. While such a process maintains the greatest degree of image fidelity, the process 600 is less effective at reducing display power consumption with images that include even a few pixels having highly saturated pixel values.

However, due to the peculiarities of the human visual system (HVS), reproducing such a high level of image fidelity is unnecessary to achieve the perception of high image fidelity. The HVS's perception of the saturation of a color at a given location in the visual field is dependent at least in part on the saturation of colors in nearby locations. In the context of an image frame, the HVS perceives a pixel having a partially saturated pixel value adjacent a pixel having a highly desaturated value as more saturated than if the pixel were located adjacent to a pixel value having a similarly saturated or more saturated pixel value. As a result, pixels having saturated pixel values included in an image frame composed primarily of pixels having desaturated pixel values will be perceived as being highly saturated even if output using less saturated colors. Accordingly, such images can be output with higher Q values, expending less illumination power, without meaningfully impacting the HVS's perception of the image. In addition, outputting images using higher Q values can in some cases improve image quality. It has been found that the dithering process discussed in stage 610 results in less dither noise when higher values of Q are used in the gamut mapping process. Thus, in addition to reducing power consumption, the use of an increase Q value can reduce the dither noise introduced into an image processed according to the process 600, thereby improving image quality. One example display process 700 for taking advantage of this feature of the HVS to increase power savings is shown in FIG. 7.

Figure 7:
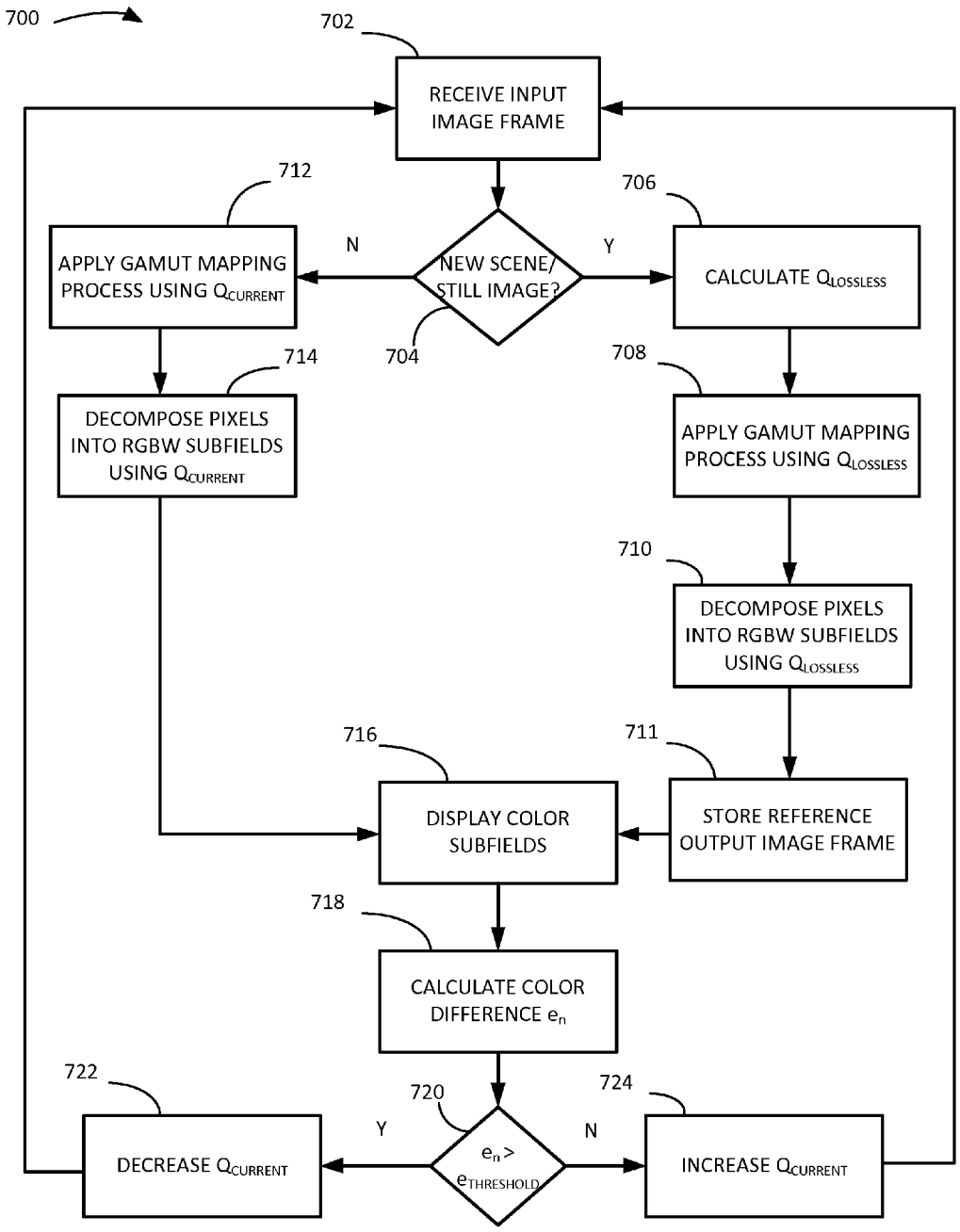

FIG. 7 shows a flow diagram of another example process 700 for generating an image on a display using the control logic 400 shown in FIG. 4. The process 700 includes receiving an input image frame (stage 702) and determining whether the input image corresponds to a new scene in a video or a new still image (decision block 704). If the input image frame corresponds to a new scene or a new still image, the process includes calculating a lossless Q value, $Q_{Lossless}$ (stage 706), applying a color gamut mapping process using $Q_{Lossless}$ to the pixels of the input image frame (stage 708), and decomposing the mapped pixel values into red, green, blue and white output color subfields using $Q_{Lossless}$ (stage 710). The process also includes storing a reference output image frame (stage 711). If the input image frame does not correspond to a new scene or a new still image, the gamut mapping process is applied to the pixels in the input image using a previously determined Q value, $Q_{current}$ (stage 712). The resulting pixel values are then decomposed into red, green, blue and white output color subfields using $Q_{Current}$ (stage 714). The method further includes displaying the output color subfields (stage 716). A color difference value, $e_n$, is calculated (stage 718) and is compared to a color difference threshold $e_{Threshold}$ (at decision block 720). If $e_n$ exceeds $e_{Threshold}$, $Q_{Current}$ is decreased (stage 722), and the next input image frame is received (stage 702). If $e_n$ falls below $e_{Threshold}$, $Q_{Current}$ is increased (stage 724), and the next input image frame is received (stage 702).

The process 700 includes receiving an input image frame (stage 702). This process stage can be similar to process stages 502 and 602 shown in FIGS. 5 and 6. For example, the input image frame can be received by the input logic 402 shown in FIG. 4 in the form of a stream of RGB pixel intensity values. As described with respect to stage 502, stage 702 can include pre-processing the pixel values and storing the results in a set of input RGB color subfields.

The input image frame is analyzed to determine if it corresponds to a new scene in a video stream or a new still image (decision block 704). In some implementations, the input logic 402 shown in FIG. 4 computes a histogram of the input image data and compares it to similar histogram data computed for one or more prior image frames. If the difference in the histograms exceeds a threshold, the input logic determines that a scene change has occurred or that the new image frame corresponds to a new still image. In some implementations, the determination may be made using metadata communicated to the input logic 402 along with or instead of the histogram data. For example, such metadata may identify the image frame as part of a video stream or as a still image. Such metadata also may identify a specific still image or video scene, in which case the input logic may compare the new image or scene identifier with an identifier associated with the prior image frame. In some implementations, the metadata may explicitly identify a correspondence between the image frame and a scene change or a new still image.

If the input image frame corresponds to a new scene or a new still image (decision block 704), the process includes calculating a new lossless Q value, $Q_{Lossless}$. In some implementations, $Q_{Lossless}$ can be calculated as described above in relation to the calculation of Q in stage 604, shown in FIG. 6.

The process 700 includes applying a color gamut mapping process using $Q_{Lossless}$ (stage 708). The gamut mapping process can be applied in a fashion similar to that discussed above in relation to stage 606 of the process 600 shown in FIG. 6. The mapped pixel values are decomposed into output RGBW color subfields (stage 710) in a manner similar to that discussed in relation to stage 608 of the process 600. The gamut mapping and pixel decomposition process stages 606 and 608, respectively, are discussed above assuming a mapping of RGB pixel intensity values to XYZ tristimulus color values and decomposing the XYZ tristimulus color values back into RGBW pixel intensity values. In some other implementations, the gamut mapping process can map RGB pixel intensity values into alternative RGB pixel intensity values associated with a desaturated output color gamut. In some implementations, the process stages are combined such that input RGB pixel intensity values are mapped directly to decomposed RGBW pixel intensity values.

A reference output image frame is saved for future use (stage 711). In some implementations, the output image reference frame is composed of the XYZ color tristimulus values resulting from the application of the gamut mapping process to the input image frame using $Q_{Lossless}$ (stage 708). In some other implementations, the reference output image frame is composed of the RGBW subfields resulting from the decomposition of the XYZ color tristimulus color values into RGBW pixel intensity values (stage 710).

Referring back to decision block 704, if the received image frame is determined not to correspond to a new scene or new still image, the process 700 includes applying the gamut mapping process using a previously determined Q value, $Q_{current}$ (stage 712). The gamut mapping process can be carried out in the same fashion as discussed above in relation to stage 708, using $Q_{current}$ instead of $Q_{Lossless}$. The resulting pixel values are likewise decomposed into RGBW color subfields (stage 714) in a similar fashion as discussed in relation to stage (710) using $Q_{Current}$.

The process stages 706, 708, and 710, 711, 712 and 714 can be carried out in some implementations by the saturation compensation logic 408 alone or in concert with the subfield derivation logic 404 included in the control logic 400 shown in FIG. 4.

The process 700 further includes displaying the RGBW color subfields (stage 716) generated for the received input image frame at either stage 710 or 716. The display of the color subfields (stage 716) can include processing similar to that discussed in relation to process stages 610, 612, and 614 of process 600, in which the color subfields are dithered (stage 610), subframes are generated (stage 612), and the generated subframes (stage 612) are output to an array of display elements (stage 614). In some other implementations, the color subfields are displayed (stage 716) using analog light modulators sequentially according to a FSC process or simultaneously using RGBW subpixel display elements. The display of the color subfields can be implemented by the subframe derivation logic 406 and the output logic 410.

As indicated above, the HVS may perceive image pixels to have a different degree of saturation than with which they are output depending on the saturation levels of neighboring pixels. As such, image pixels can be output with a lossy Q value resulting in somewhat desaturated pixel values without unduly denigrating perceived image quality. However, if the absolute level of desaturation resulting from the lossy Q value is too great, or if the image includes a sufficiently large number of saturated pixels, the HVS will detect the desaturation and perceive it as decreased image quality. To avoid outputting images using unduly large Q values while still saving power by using lossy $Q_{current}$ values, the impact of the $Q_{current}$ value on the HVS's perception of the output image frame can be calculated and updated after each image frame (or until $Q_{current}$ converges or a number of $Q_{current}$ updates have occurred) by comparing output image frames to the reference output image frame saved at stage 711 and adjusting $Q_{current}$ based on the comparison.

Accordingly, the process 700 includes calculating a color difference $e_n$ between the output image frame and the reference output image frame (stage 718). In some implementations, $e_n$ is calculated as an average color difference between the two image frames. In some implementations, the color difference corresponds solely to a difference in chromaticity. In some other implementations, the difference corresponds to a difference in both chromaticity and luminance. The average color difference can be based on a retinex color measure. Retinex color theory includes a color measure that attempts to model the HVS's perception of color, taking into the account the spatial proximity of a given color to adjacent colors. Accordingly, the retinex color theory is particularly well suited for evaluating the results of applying a $Q_{current}$ value. In some other implementations, other color difference measures can be used instead of a retinex theory based measure. For example, in some implementations, $e_n$ is calculated based on the average Euclidean distance between the pixel values of output image frame and the reference image frame on a pixel-by-pixel basis in the RGB, RGBW, XYZ, L*a*b* or other color space.

If the color difference $e_n$ exceeds a color difference threshold $e_{Threshold}$ (at decision block 720), $Q_{current}$ is decreased (stage 722) to reduce the color difference in subsequently received and processed image frames. In some implementations, $Q_{current}$ is reduced by a value $\Delta Q_{dec}$. $\Delta Q_{dec}$ can be calculated according to the equation:

$$\Delta Q_{dec}=\tfrac{1}{2}(Q_{Current}-Q_{Lossless}).$$

If the color difference $e_n$ falls below the threshold $e_{Threshold}$ (at decision block 720), an opportunity exists to save additional power without unduly effecting perceived image fidelity. As such, $Q_{Current}$ is increased by a value $\Delta Q_{inc}$ (stage 724) for use in future received and processed image frames. In some implementations, $\Delta Q_{inc}$ can be calculated according to the equation:

$$\Delta Q_{inc}=\tfrac{1}{4}(1-e_n/e_{Threshold}).$$

The threshold can vary from display to display and can be set based on empirical data associated with the output characteristics of a given display. A wide variety of alternative equations and algorithms can be employed to calculate appropriate values for $\Delta Q_{dec}$ and $\Delta Q_{inc}$ or otherwise vary the value of $Q_{current}$ in the above process. For example, in some implementations, the control logic 400 can alter the $Q_{current}$ values in the above process according to a proportional-integral-derivative (PID) controller-based process. Use of a PID controller based process for varying $Q_{current}$ can result in a smooth convergence to a final Q value. A smooth convergence can reduce the likelihood of the above process resulting in any image artifacts due to the changing of $Q_{current}$ from frame to frame. Process stage 718, 722 and 724, along with the decision block 720 can be implemented, in some implementations, by the saturation compensation logic 408.

In some implementations, the process 700 can continue as described above indefinitely. In some implementations, the process 700 can continue for a given still image or video scene until the value of $Q_{Current}$ converges or for a defined or configurable number of image frames.

Figure 8:
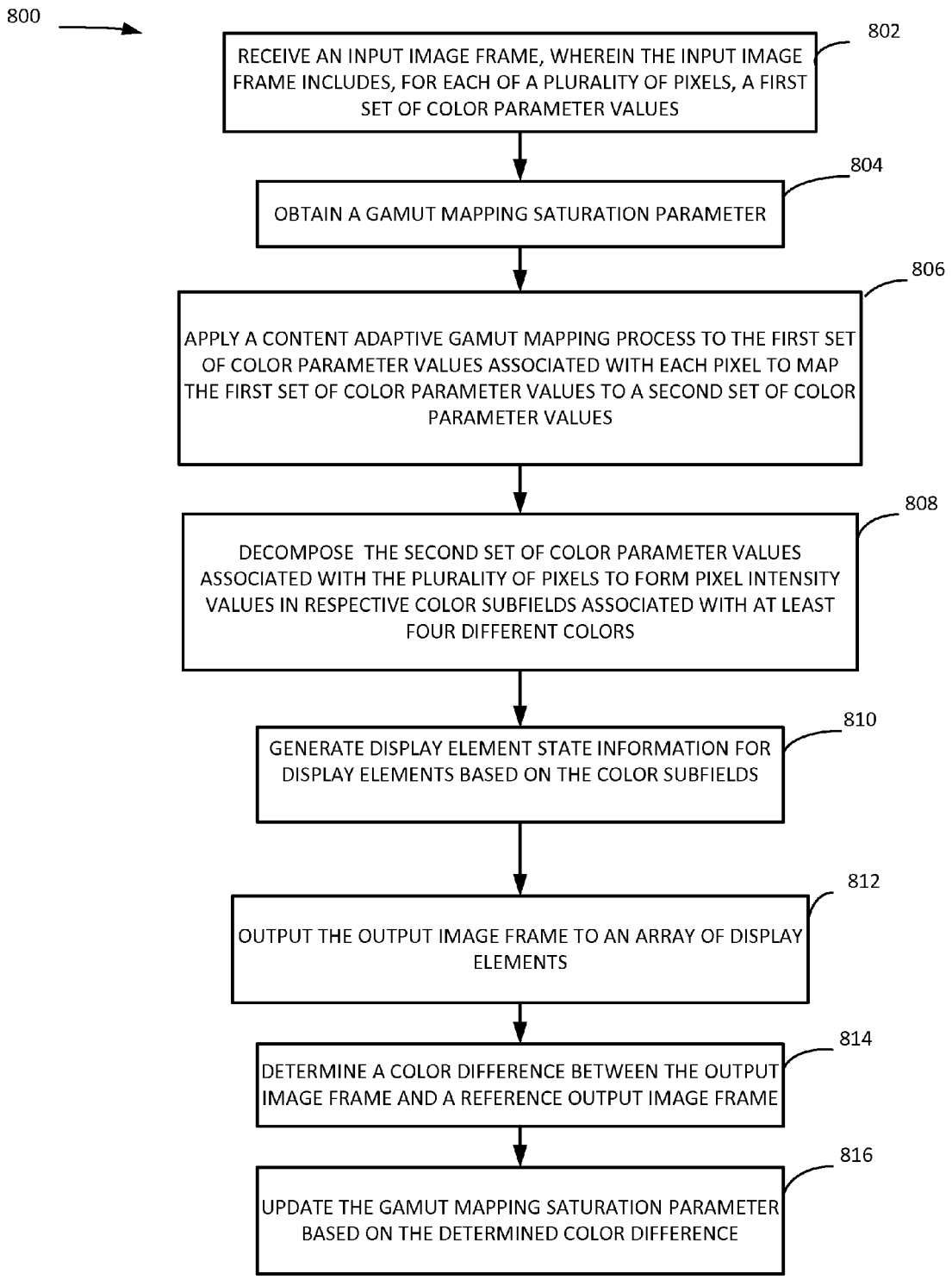

FIG. 8 shows a flow diagram of another example process 800 for generating an image on a display using the control logic 400 shown in FIG. 4. The process 800 includes receiving an input image frame (stage 802). The input image includes, for each of a plurality of pixels, a first set of color parameter values. This process stage can be similar to process stages 502, 602, and 702 of FIGS. 5-7, respectively, in which an input image is received as a stream of RGB pixel intensity values.

The process 800 further includes obtaining a gamut mapping saturation parameter (stage 804). An example of such a parameter is the Q value discussed above. The obtained gamut mapping saturation parameter can be a lossless Q value, such as $Q_{Lossless}$ used in the process 700 shown in FIG. 7, or a lossy Q value, such as $Q_{Current}$, also used in the process 700. As such, the gamut mapping saturation parameter can be retrieved from memory or calculated based on the color content of the received image frame.

The process 800 also includes, for each pixel in the received input image frame, using the obtained gamut mapping saturation parameter, applying a content adaptive gamut mapping process to the first set of color parameter values associated with the pixel to map the first set of color parameter values to a second set of color parameter values (stage 806). For example, this process stage can be similar to stages 708 or 712 of the process 700 shown in FIG. 7. These example process stages convert RGB pixel intensity values to XYZ tristimulus values. In some other implementations, the RGB pixel intensity values can be gamut mapped to a different color space, such as an RGBW color space or a L*a*b* color space.

The second set of color parameter values associated with the plurality of pixels of the image frame are decomposed to form pixel intensity values in respective color subfields associated with at least four different colors (stage 808). Process stages 710 and 714 are examples of suitable decomposition processes that can be used in stage 808. For example, XYZ tristimulus color values for each of the image frame pixels can be decomposed to RGBW pixel intensity values and aggregated into RGBW subfields.

The process 800 can further include generating display element state information for display elements in an array of display elements based on the color subfields (stage 810). Examples of this process stage were discussed above in relation to stages 510, 612, and 716 of processes 500, 600, and 700 shown in FIGS. 5-7. For example, the generation of display element state information can include generating subframes for a time division gray scale image formation process or analog light modulator state values. The output image frame is output to the array of display elements (stage 812) for example by loading the generated display element state information into the array of display elements according to an output sequence and illuminating a backlight to illuminate the display elements.

The process 800 also includes determining a color difference between the output image frame and a reference image frame (stage 814). The reference image frame can be, for example, the identical image or an image frame of the same video scene processed with a lossless gamut mapping saturation. An example of this process stage is shown as process stage 718 of process 700. The gamut mapping saturation parameter is updated based on the determined color difference (stage 816). Examples of this update stage include stages 722 and 724 of the process 700. In some implementations, the gamut mapping saturation parameter is based on whether the color difference exceeds a color difference threshold, for example, as discussed in relation to decision block 720 of the process 700.

FIGS. 9A and 9B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be capable of including a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 9B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 9A, can be capable of functioning as a memory device and be capable of communicating with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to any of the IEEE 16.11 standards, or any of the IEEE 802.11 standards. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1×EV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G, or further implementations thereof, technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29 is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40. Additionally, in some implementations, voice commands can be used for controlling display parameters and settings.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus comprising:

an array of display elements;

control logic configured to:

receive an input image frame, wherein the input image frame includes, for each of a plurality of pixels, a first set of color parameter values;

generate an output image frame by:

obtaining a gamut mapping saturation parameter;

for each pixel in the received image frame, using the gamut mapping saturation parameter, applying a content adaptive gamut mapping process to the first set of color parameter values associated with the pixel to map the first set of color parameter values to a second set of color parameter values;

decomposing the second set of color parameter values associated with the plurality of pixels to form pixel intensity values in respective color subfields associated with at least four different colors; and generating display element state information for the display elements based on the color subfields;

output the output image frame to the array of display elements;

determine a color difference between the output image frame and a reference output image frame; and update the gamut mapping saturation parameter based on the determined color difference.

2. The apparatus of claim 1, wherein updating the gamut mapping saturation parameter comprises:

comparing the determined color difference to a threshold color difference; and in response to the color difference falling below the threshold color difference, adjusting the gamut mapping saturation parameter to increase the color difference in a subsequently generated output image frame.

3. The apparatus of claim 1, wherein updating the gamut mapping saturation parameter comprises:

comparing the determined color difference to a threshold color difference; and in response to the color difference exceeding threshold color difference, adjusting the gamut mapping saturation parameter to decrease the color difference in a subsequently generated output image frame.

4. The apparatus of claim 1, wherein the reference output image frame includes an output image resulting from the application of the gamut mapping process to a reference input image frame using a gamut mapping saturation parameter that yields more desaturation to a reference image frame.

5. The apparatus of claim 4, wherein the reference input image frame includes an image in a same video scene as the received input image frame.

6. The apparatus of claim 4, wherein the received input image frame is a still image, and the reference input image frame includes the identical image data to the received input image frame.

7. The apparatus of claim 4, wherein the control logic further configured to generate the reference output image frame using a lossless gamut mapping saturation parameter.

8. The apparatus of claim 1, wherein the color difference includes a retinex measure indicating an average color difference between the output image frame and the reference output image frame.

9. The apparatus of claim 1, wherein obtaining the gamut mapping saturation parameter includes determining that the received image frame is associated with a scene change and identifying a lossless gamut mapping saturation parameter for the received image frame.

10. The apparatus of claim 1, wherein the first set of color parameter values include red, green, and blue pixel intensity values and the second sets of color parameter values comprise XYZ tristimulus values.

11. The apparatus of claim 1, wherein the color difference is indicative of a difference in at least one of chromaticity and luminance.

12. The apparatus of claim 1, wherein updating the gamut mapping saturation parameter includes applying a proportional-integral-derivative (PID) controller-based updating process.

13. The apparatus of claim 1, further comprising:

a display including the array of display elements;

a processor capable of communicating with the display, the processor being capable of processing image data; and a memory device capable of communicating with the processor.

14. The apparatus of claim 13, further comprising:

a driver circuit capable of sending at least one signal to the display; and a controller capable of sending at least a portion of the image data to the driver circuit.

15. The apparatus of claim 13, further including an image source module capable of sending the image data to the processor, wherein the image source module includes at least one of a receiver, transceiver, and transmitter.

16. The apparatus of claim 13, the display device further including an input device capable of receiving input data and to communicate the input data to the processor.

17. A non-transitory computer readable medium storing computer executable instructions, which when executed by a processor cause the processor to carry out a method of forming an image on a display, comprising:

receiving an input image frame, wherein the input image frame includes, for each of a plurality a pixels, a first set of color parameter values;

generating an output image frame by:

obtaining a gamut mapping saturation parameter;

for each pixel in the received image frame, using the gamut mapping saturation parameter, applying a content adaptive gamut mapping process to the first set of color parameter values associated with the pixel to map the first set of color parameter values to a second set of color parameter values;

decomposing the second set of color parameter values associated with the plurality of pixels to form pixel intensity values in respective color subfields associated with at least four different colors;

generating display element state information for display elements in an array of display elements of the display based on the color subfields; and outputting the output image frame to the array of display elements;

determining a color difference between the output image frame and a reference output image frame; and updating the gamut mapping saturation parameter based on the determined color difference.

18. The non-transitory computer readable medium of claim 17, wherein updating the gamut mapping saturation parameter comprises:

comparing the determined color difference to a threshold color difference; and in response to the color difference falling below the threshold color difference, adjusting the gamut mapping saturation parameter to increase the color difference in a subsequently generated output image frame;

in response to the color difference exceeding the threshold color difference, adjusting the gamut mapping saturation parameter to decrease the color difference in a subsequently generated output image frame.

19. The non-transitory computer readable medium of claim 17, wherein the reference output image frame includes an output image resulting from the application of the gamut mapping process to a reference input image frame using a lossless gamut mapping saturation parameter.

20. The non-transitory computer readable medium of claim 19, wherein the reference input image frame includes one of an image in a same video scene as the received input image frame and an image frame including the identical image data to the received input image frame.

21. The non-transitory computer readable medium of claim 19, wherein the method further includes generating the reference output image frame using a lossless gamut mapping saturation parameter.

22. The non-transitory computer readable medium of claim 17, wherein the color difference includes a retinex measure indicating an average color difference between the output image frame and the reference output image frame.

23. The non-transitory computer readable medium of claim 17, wherein obtaining the gamut mapping saturation parameter comprises includes determining that the received image frame is associated with a scene change and identifying a lossless gamut mapping saturation parameter for the received image frame.

24. The non-transitory computer readable medium of claim 17, wherein the first set of color parameter values include red, green, and blue pixel intensity values and the second sets of color parameter values comprise XYZ tristimulus values.

25. The non-transitory computer readable medium of claim 17, wherein updating the gamut mapping saturation parameter includes applying a proportional-integral-derivative (PID) controller-based updating process.

* * * * *